US012721413B2

(12) United States Patent
Chi

(10) Patent No.: US 12,721,413 B2
(45) Date of Patent: Sep. 1, 2026

(54) HAIR STRAIGHTENING APPLIANCE WITH ADJUSTABLE HEAT PLATE

(71) Applicant: CONAIR LLC, Stamford, CT (US)

(72) Inventor: Chan Ngan Chi, Ma On Shan (HK)

(73) Assignee: CONAIR LLC, Stamford, CT (US)

( * ) Notice: Subject to any disclaimer, the term of this patent is extended or adjusted under 35 U.S.C. 154(b) by 50 days.

(21) Appl. No.: 18/813,776

(22) Filed: Aug. 23, 2024

(65) Prior Publication Data

US 2026/0053249 A1 Feb. 26, 2026

(51) Int. Cl.
*A45D 2/00* (2006.01)

(52) U.S. Cl.
CPC ..... *A45D 2/001* (2013.01)

(58) Field of Classification Search
CPC ..... A45D 2/001
See application file for complete search history.

(56) References Cited

U.S. PATENT DOCUMENTS

| | | | |
|---|---|---|---|
| D534,684 S | 1/2007 | Ceva | |
| D596,790 S | 7/2009 | Rizzuto | |
| D596,799 S | 7/2009 | Kwok | |
| D605,357 S | 12/2009 | Kwok | |
| D618,395 S | 6/2010 | Mau | |
| D672,088 S | 12/2012 | Julemont | |
| D816,900 S | 5/2018 | Di Marco | |
| 10,925,368 B2 * | 2/2021 | Parris | A45D 7/02 |
| D919,176 S | 5/2021 | Zheng et al. | |
| D990,043 S | 6/2023 | Brady et al. | |
| D1,004,192 S | 11/2023 | Lai | |

(Continued)

FOREIGN PATENT DOCUMENTS

| | | |
|---|---|---|
| CN | 114847611 A | 8/2022 |
| EM | 015092955-0001 | 2/2025 |
| MX | F/2025/000515 | 5/2025 |

OTHER PUBLICATIONS

BabylissPRO Nano Titanium Professional Extended 1.25 Ionic Flat Iron [online], [site visited Aug. 4, 2025]. Available from internet, URL: <https:///www.amazon.com/BabylissPRO-Titanium-Professional-Extended-Ionic/dp/B0DP1MZQ6P/?th=1> (Year: 2025).

(Continued)

*Primary Examiner* — Khaled Annis
(74) *Attorney, Agent, or Firm* — Ruggiero McAllister & McMahon LLC

(57) ABSTRACT

A hair straightening appliance with an adjustable heat plate includes a first handle and a second handle that are configured for relative movement between an open position for receiving hair therebetween and an approximated position for clamping hair. The first handle and the second handle are each configured to impart a straightening effect on hair when clamped. At least one of the first heating plate and the second heating plate are adjustable. When the first heating plate is adjustable, the first heating plate is selectively mounted rigidly with respect to the first housing or in a partially or fully resiliently mounted manner with respect to the first housing, and, when the second heating plate is adjustable, the second heating plate is selectively mounted rigidly with respect to the second housing or in a partially or fully resiliently mounted manner with respect to the second housing.

20 Claims, 17 Drawing Sheets

(56) References Cited

U.S. PATENT DOCUMENTS

| | | | | |
|---|---|---|---|---|
| D1,017,900 | S | 3/2024 | Pan | |
| D1,052,173 | S | 11/2024 | Wang | |
| D1,059,679 | S | 1/2025 | Fu | |
| 2009/0114240 | A1* | 5/2009 | Leung | A45D 1/06 132/224 |
| 2011/0083695 | A1* | 4/2011 | Abbasi | A45D 1/04 132/269 |
| 2012/0272994 | A1* | 11/2012 | Sayers | A45D 2/002 132/223 |
| 2013/0319452 | A1* | 12/2013 | Joo | A45D 2/001 132/223 |
| 2015/0335121 | A1* | 11/2015 | Floessholzer | A45D 1/04 132/269 |
| 2017/0164707 | A1 | 6/2017 | Cowdry et al. | |
| 2022/0322802 | A1 | 10/2022 | Debenedictis et al. | |
| 2023/0025568 | A1* | 1/2023 | Falah | A45D 2/001 |
| 2023/0180904 | A1* | 6/2023 | Fang | A45D 1/28 132/271 |

OTHER PUBLICATIONS

International Search Report and Written Opinion dated Oct. 3, 2025 from corresponding International Patent Application No. PCT/US2025/039255, 13 pages.

* cited by examiner

FLOATING SELECTION BUTTON AT UNLOCKED POSITION

SECTION B-B

SECTION C-C

TOP VIEW

SECTION A-A

TOP VIEW (REMOVED HEAT PLATE)

FLOATING SELECTION BUTTON AT LOCKED POSITION

SECTION B-B

SECTION C-C

TOP VIEW

SECTION A-A

TOP VIEW (REMOVED HEAT PLATE)

HAIR STRAIGHTENING APPLIANCE WITH ADJUSTABLE HEAT PLATE

BACKGROUND

1. Field of the Disclosure

The present disclosure relates to hair straightening appliances. In particular, the present disclosure is related to a hair straightening appliance with an adjustable heat plate.

2. Description of Related Art

A variety of different devices and methods may be used for straightening hair. For example, a user may employ hair straightening irons or a hairbrush to place tension on his or her hair while applying heated air with a hair dryer. Typical hair straightening irons straighten hair by compressing hair between flat heated plates. The heated plates are each generally only in a single configuration on the hair straightening iron. The single configuration of the heated plates can restrict use of the hair straightening iron.

Accordingly, it has been determined by the present disclosure that there is a continuing need for a device that overcomes, alleviates, and/or mitigates one or more of the aforementioned and other deleterious effects of prior devices.

SUMMARY

The present disclosure provides a hair straightening appliance that is adjustable so that one or more heated plates are selectively mounted rigidly or resiliently with respect to the hair straightening appliance's housing.

There are certain hair treatments that require more attention and more control over the tension that is applied, for example, a Keratin treatment, thus, the hair straightening appliance of the present disclosure is adjustable so that one or more heated plates are selectively mounted rigidly or resiliently with respect to the hair straightening appliance's housing to provide the desired attention and control over this tension.

The above-described and other features and advantages of the present disclosure will be appreciated and understood by those skilled in the art from the following detailed description, drawings, and appended claims.

DETAILED DESCRIPTION

Figure 1:
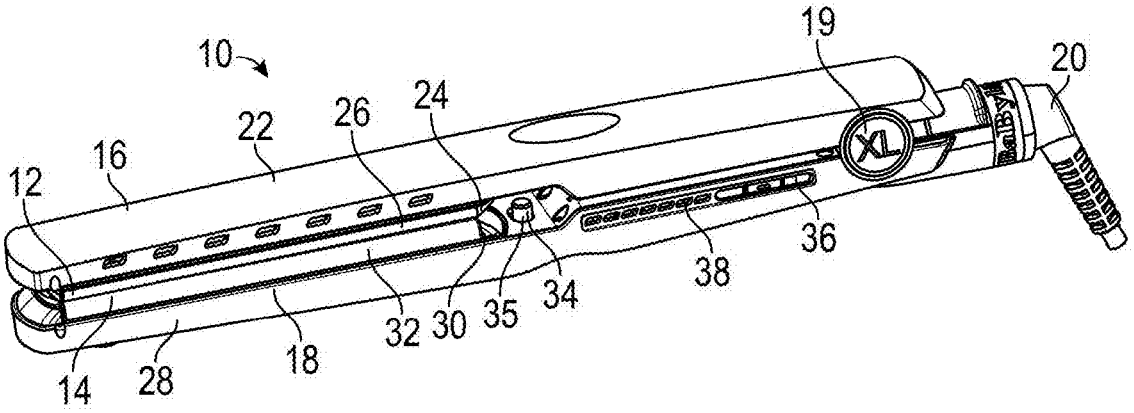
FIG. 1 is a top perspective view of a hair straightening appliance according to the present disclosure.
Figure 2:
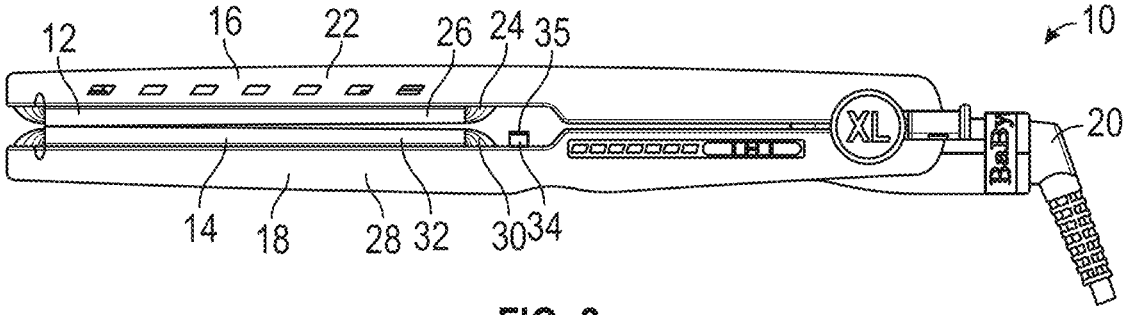
FIG. 2 is a side view of the hair straightening appliance of FIG. 1.
Figure 3:
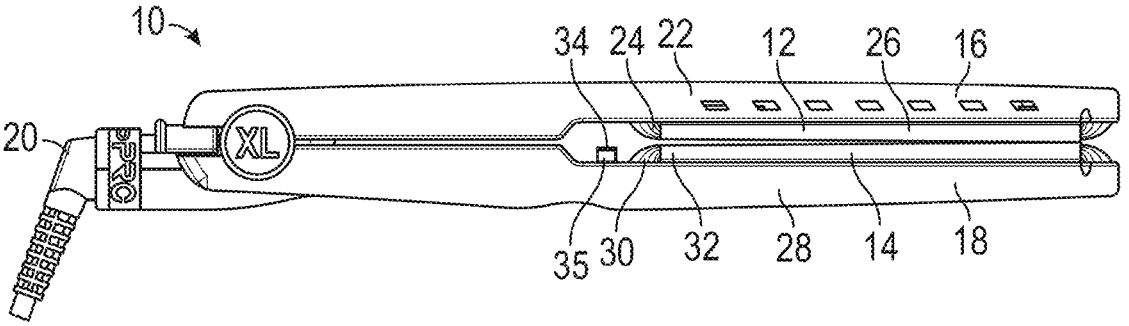
FIG. 3 is an opposite side view of the hair straightening appliance of FIG. 2.
Figure 4:
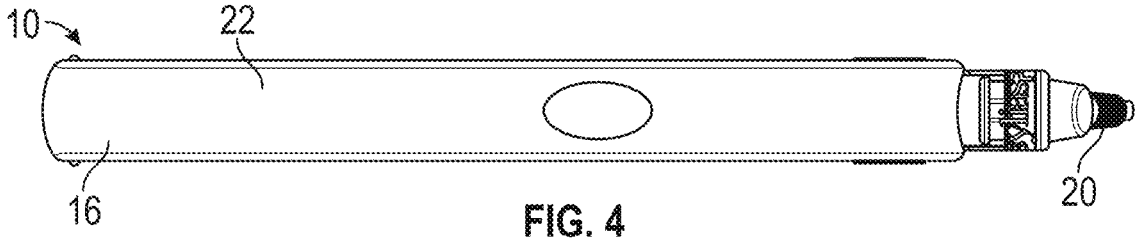
FIG. 4 is a top view of the hair straightening appliance of FIG. 1.
Figure 5:
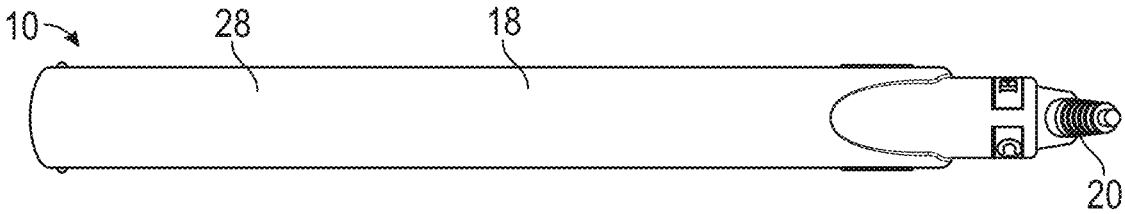
FIG. 5 is a bottom view of the hair straightening appliance of FIG. 1.
Figure 6:
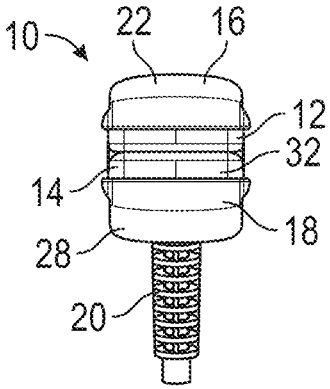
FIG. 6 is a front view of the hair straightening appliance of FIG. 1.
Figure 7:
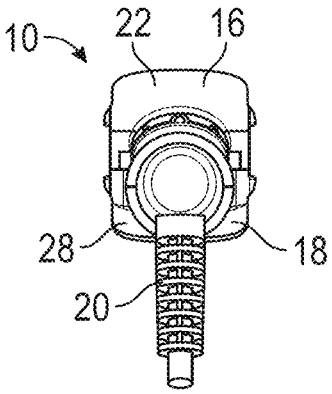
FIG. 7 is a rear view of the hair straightening appliance of FIG. 1.

Referring to the drawings and in particular to FIG. 1, an exemplary embodiment of a hair straightening appliance according to the present disclosure is shown and is generally referred to by reference numeral 10, hereinafter referred to as "appliance 10". Advantageously, appliance 10 is a hair straightening iron that has at least one or both of a first heating plate 12 and a second heating plate 14 that can be selectively adjusted from fixed to floating. In other words, one or both of first heating plate 12 and second heating plate 14 are adjustable to be rigidly fixed in appliance 10, or one or both of first heating plate 12 and second heating plate 14 can be selectively set to "float" in a resilient manner so that when appliance 10 is closed around a user's hair, one or both of first heating plate 12 and second heating plate 14 will give or retract a little bit, under spring bias, so as to not crush the hair. There are certain hair treatments that require more attention and more control over the tension that is applied, for example, a Keratin treatment. This desired attention and control over tension can be provided by the adjustability of first heating plate 12 and/or second heating plate 14 to be rigidly fixed, partially floating or fully floating on appliance 10.

Referring to FIGS. 1-7, appliance 10 has a first handle 16 and a second handle 18 that are connected to each other at one end 19 forming tongs. First handle 16 has a first housing 22 connected to a first support 24 and a first heating plate assembly 26. Second handle 18 has a second housing 28 connected to a second support 30 and a second heating plate assembly 32. Appliance 10 has a floating selection switch assembly 34 with a floating selection switch 35 extending through second support 30. Second handle 18 is connected to a power cord 20 adjacent the connection with first handle 16. Second handle 18 has one or more buttons 36 and one or more lights 38 that light up to provide an indication to the user different conditions of operation of appliance 10.

Figure 27:
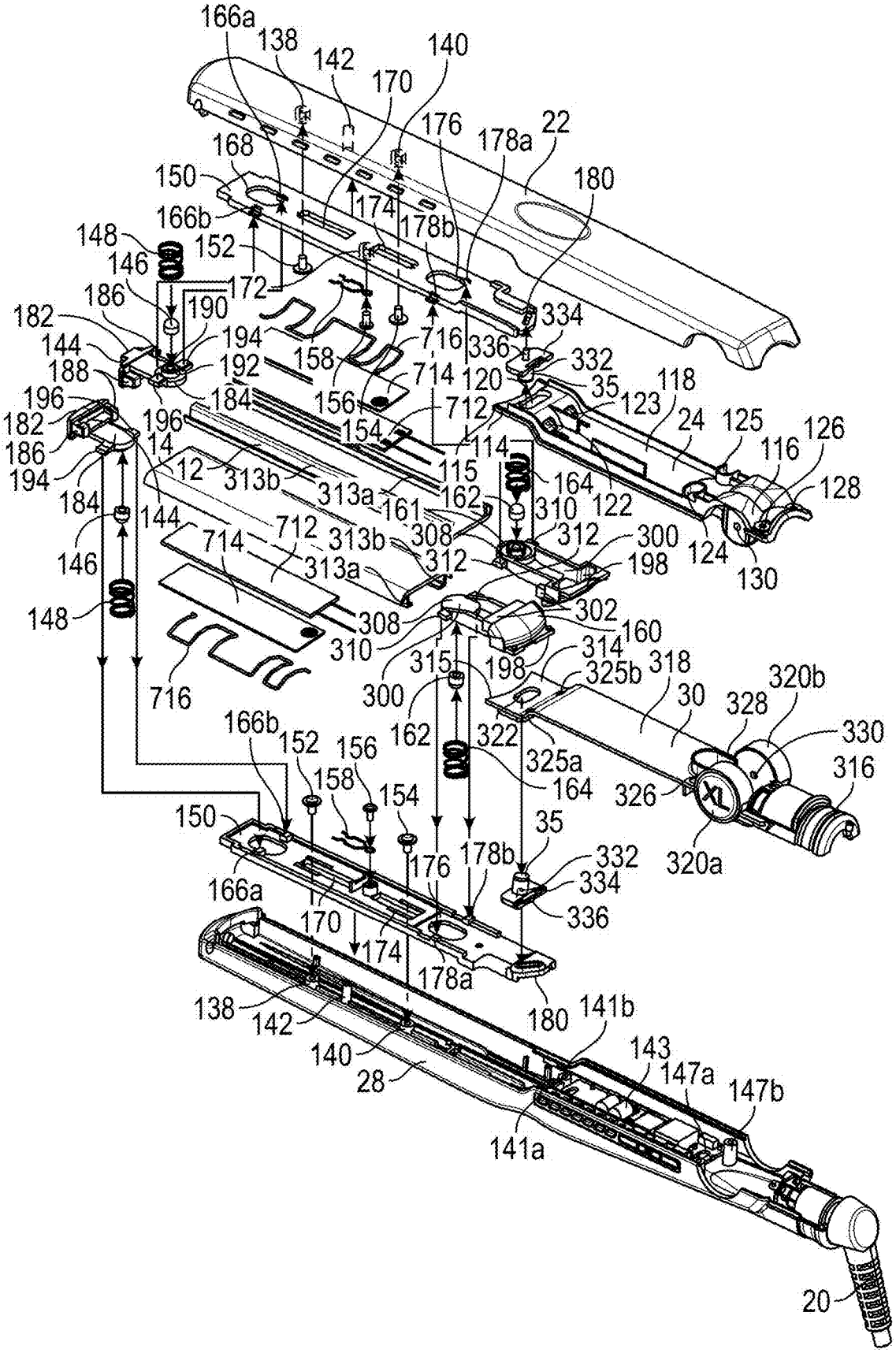
FIG. 27 is an exploded, side perspective view of the hair straightening appliance of FIG. 1 modified to include a first heating plate that is adjustable.
Figure 28:
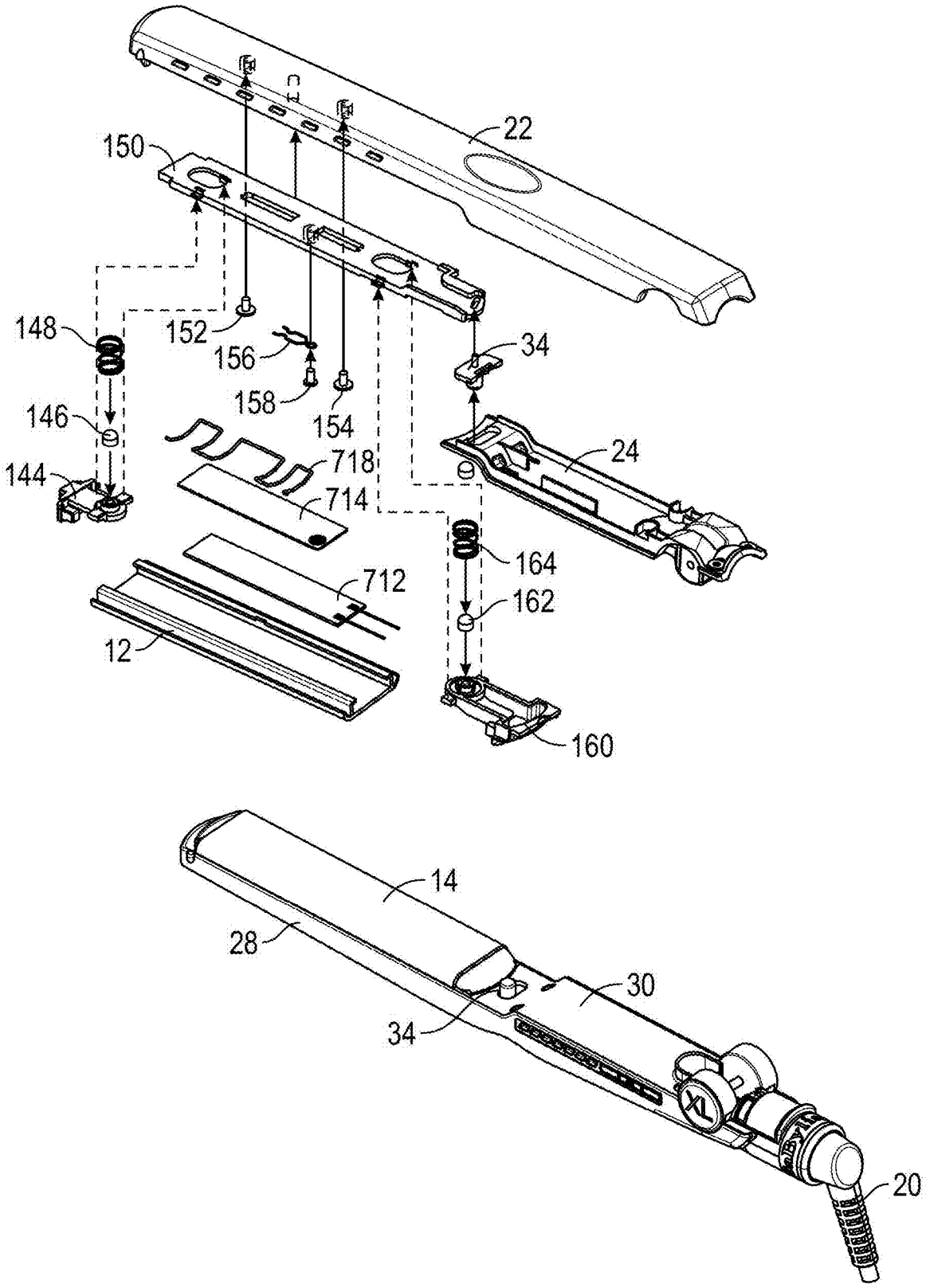
FIG. 28 is an exploded, side perspective view of the hair straightening appliance of FIG. 1 modified to include the first heating plate that is adjustable and a second heating plate that is non-adjustable.

Appliance 10 can have one or both of first heating plate 12 and second heating plate 14 that can be selectively adjusted from fixed to floating. FIGS. 1-26 show appliance 10 that only has second heating plate 14 that can be selectively adjusted from fixed to floating. FIG. 27 shows appliance 10 that has both first heating plate 12 and a second heating plate 14 that can be selectively adjusted from fixed to floating. Another alternative shown in FIG. 28 is appliance 10 that only has first heating plate 12 that can be selectively adjusted from fixed to floating.

Figure 8:
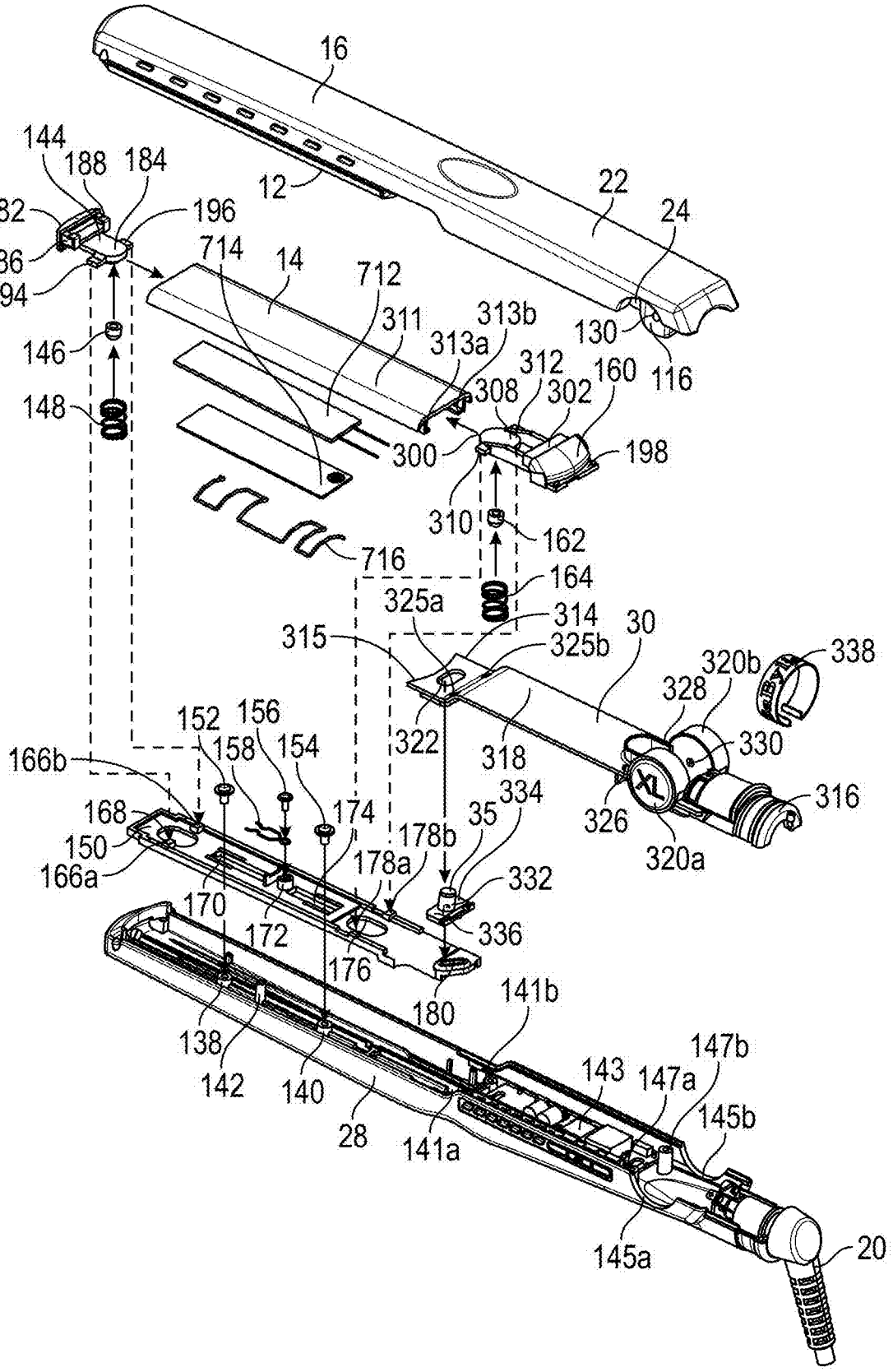
FIG. 8 is an exploded, side perspective view of the hair straightening appliance of FIG. 1.
Figures 42, 43:
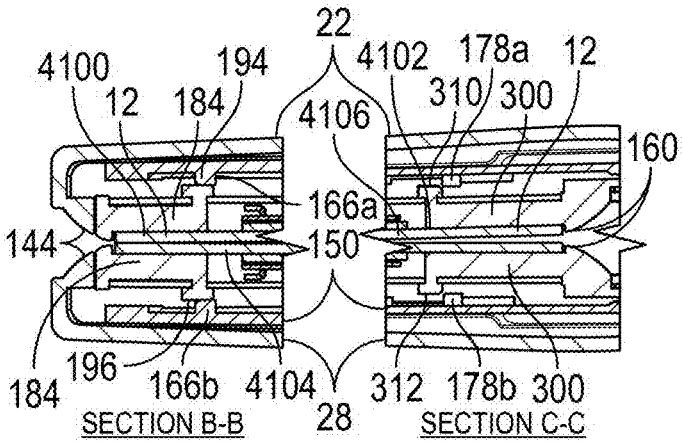
FIG. 42 is a partial, side cross-sectional view taken along line B-B of FIG. 40 of the hair straightening appliance of FIG. 29 with the first heating plate and the second heating plate in the front fixed and rear floating configuration.
FIG. 43 is a partial, side cross-sectional view taken along line C-C of FIG. 40 of the hair straightening appliance of FIG. 29 with the first heating plate and the second heating plate in the front fixed and rear floating configuration.
Figure 40:
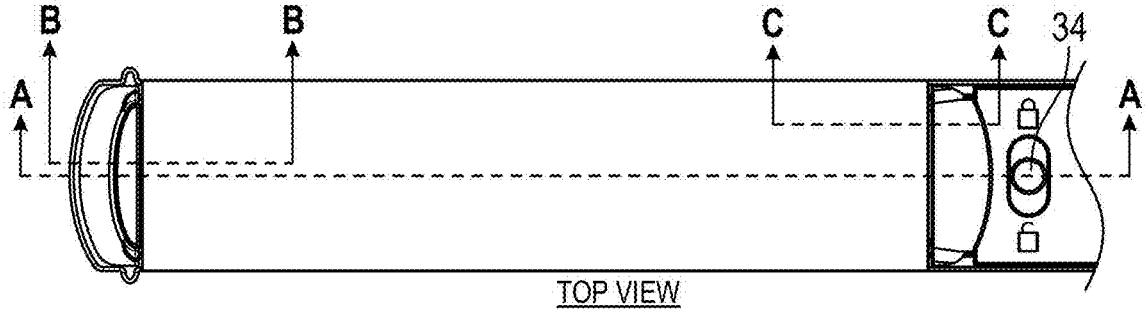
FIG. 40 is a partial, top view of the hair straightening appliance of FIG. 29 with the first heating plate and the second heating plate in the front fixed and rear floating configuration.

Referring to FIG. 8, first handle 16 has first heating plate 12. First heating plate 12 is connected to first housing 22 so that first heating plate 12 is fixed at a front portion 4100 and floating in at a rear portion 4102 which is the same configuration as shown in FIGS. 42 and 43, however, first heating plate 12 is non-adjustable such that a second floating selection switch assembly 34 can be omitted from first handle 16. Alternatively, first heating plate 12 is non-adjustable and connected to first housing 22 so that first heating plate 12 is fully floating. Another alternative is that first heating plate 12 is non-adjustable and connected to first housing 22 so that first heating plate 12 is fixed. First support 24 of first handle 16 has rear curved portion 116, and a first rotation aperture 130 through each side of first rear curved portion 116.

Second handle 18 has receptacles 138, 140, middle receptacles 141*a*, 141*b*, an extension 142, and rear receptacles 147*a*, 147*b* that each extend from second housing 28. Second housing 28 also houses a controller 143, for example, a microcontroller unit and printed circuit board, to control operation of appliance 10, and receives power cord 20. Second handle 18 has cutouts 145*a*, 145*b* formed in second housing 28 between controller 143 and power cord 20.

Second heating plate assembly 32 has second heating plate 14, a front insulator 144, a front floating flexible cover 146, a front floating spring 148, a sliding block 150, fasteners 152 and 154, a selection fastener 156, a detent spring 158, a rear insulator 160, a rear floating flexible cover 162, and a rear floating spring 164. Sliding block 150 has front rigid bosses 166*a*, 166*b*, a forward opening 168, a forward track opening 170, a receptacle 172, a rear track opening 174, a rear opening 176, rear rigid bosses 178*a*, 178*b*, and a cam slot 180. Front floating flexible cover 146 and rear floating flexible cover 162 are a flexible material, for example, silicone. Front floating spring 148 and rear floating spring 164 can be resilient material, for example, springs or silicone pads. Front insulator 144 has a front connection portion 182 on a forward edge and front tab 184 and front posts 186, 188 extending from an opposite rear edge. Front insulator 144 has a front protuberance 190 (FIG. 11) and a front circular wall 192 (FIG. 11) surrounding front protuberance 190 formed on a surface of front tab 184 facing second housing 28. Front insulator 144 has front rigid bosses 194, 196 extending from opposite sides of front tab 184. Rear insulator 160 has a rear connection portion 198 on a forward edge and a rear tab 300 and a rear post 302 extending from an opposite rear edge. Rear insulator 160 has a rear protuberance 161 (FIG. 11), and a rear circular wall 308 (FIG. 11) surrounding rear protuberance 161 formed on a surface of rear tab 300 facing second housing 28. Rear insulator 160 has rear rigid bosses 310, 312 extending from opposite sides of rear tab 300. Second heating plate 14 forms a flat surface 311 on a first side and has opposing second L-shaped members 313*a*, 313*b* on an opposite side.

Second support 30 has a second forward curved portion 314 at one end, a second rear half cylindrical portion 316 at the opposite end, and second middle support portion 318 therebetween. Forward curved portion 314 has a second edge 315.

Figure 11:
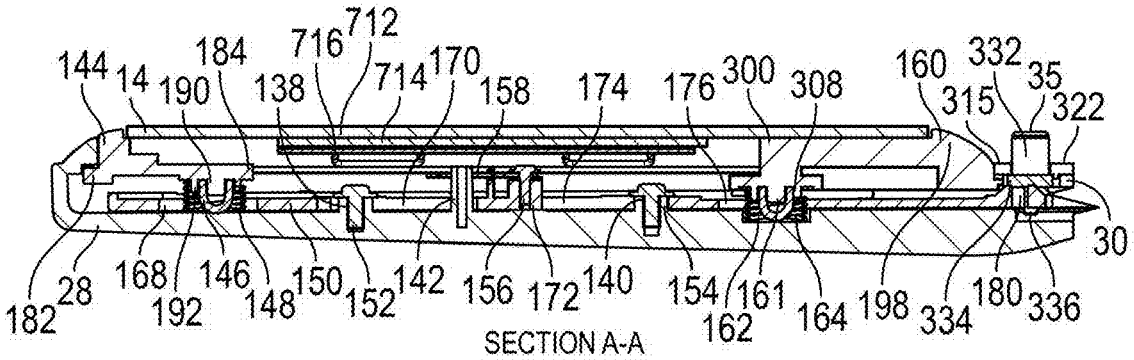
FIG. 11 is a partial, side cross-sectional view taken along line A-A of FIG. 10 of the hair straightening appliance of FIG. 1 with the second heating plate in the fixed configuration.

Second support 30 has circular members 320*a*, 320*b* formed between second middle support portion 318 and second rear half cylindrical portion 316. Second support 30 has a second support opening 322 through second forward curved portion 314, second front apertures 325*a*, 325*b*, second middle apertures 326, 328 through middle support portion 318, and a second rotation opening 330 in each of circular members 320*a*, 320*b*. Floating selection switch assembly 34 has floating selection switch 35, a decoration ring 332, a switch 334 and a rod 336 (FIG. 11). Rod 336 is sized to fit in cam slot 180 through sliding block 150. Appliance 10 has a decorative ring 338.

Still referring to FIG. 8, second support 30 is connected to second housing 28, for example, by fasteners that pass through one or more of second front apertures 325*a*, 325*b*, second middle apertures 326, 328 and one or more of middle receptacles 141*a*, 141*b* and rear receptacles 147*a*, 147*b*. Decorative ring 338 can fit over a rear portion of both second housing 28 and second rear half cylindrical portion 316 when they are connected adjacent to power cord 20. First support 24 that is connected to first housing 22 is rotatably connected to second support 30 that is connected to second housing 28 by first rear curved portion 116 that is positioned in between circular members 320*a*, 320*b* so that a fastener, for example, a pivot pin for opening and closing the housing, is passed through first rotation apertures 130 through each side of first rear curved portion 116 and second rotation opening 330 in each of circular members 320*a*, 320*b* forming tongs. A biasing member biasing first housing 22 away from second housing 28 may also be included in the rotatable connection between first support 24 and second support 30.

Figure 9:
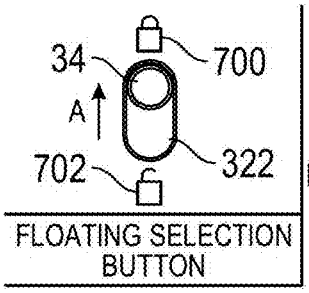
FIG. 9 is an enlarged view of a floating selection switch assembly of the hair straightening appliance of FIG. 1 in a fixed setting location.
Figure 12:
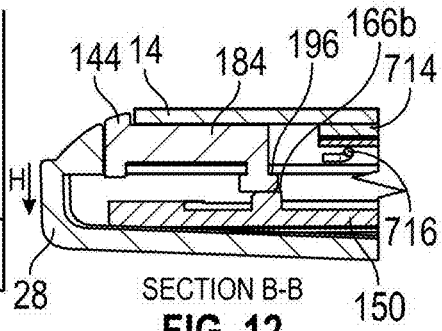
FIG. 12 is a partial, side cross-sectional view taken along line B-B of FIG. 10 of the hair straightening appliance of FIG. 1 with the second heating plate in the fixed configuration.
Figure 13:
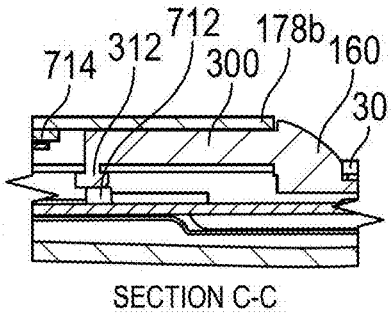
FIG. 13 is a partial, side cross-sectional view taken along line C-C of FIG. 10 of the hair straightening appliance of FIG. 1 with the second heating plate in the fixed configuration.
Figure 10:
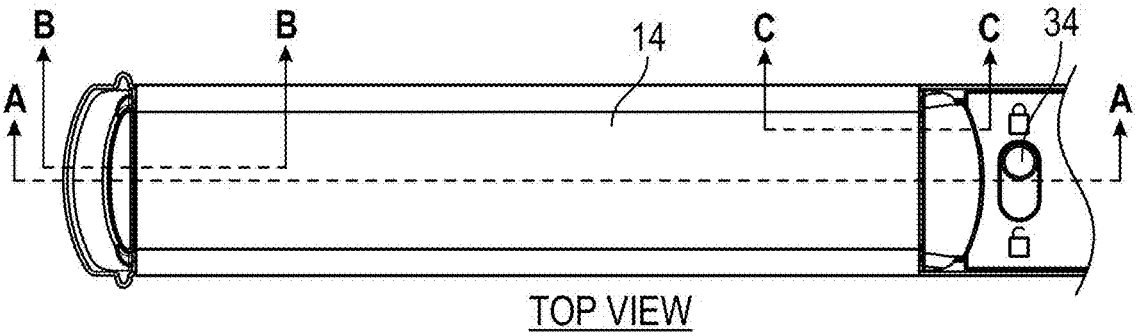
FIG. 10 is a partial, top view of the hair straightening appliance of FIG. 1 with the second heating plate in a fixed configuration.
Figure 14:
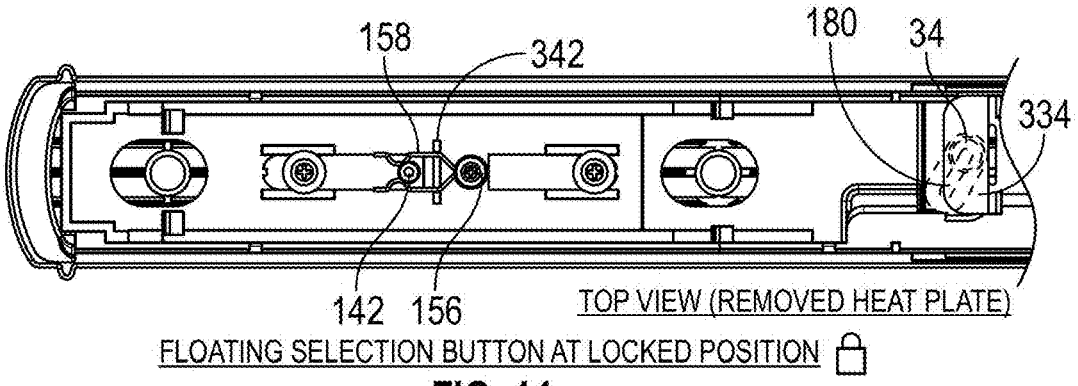
FIG. 14 is a partial, top view of the hair straightening appliance of FIG. 1 with the second heating plate in the fixed configuration and with the second heating plate removed.
Figure 16:
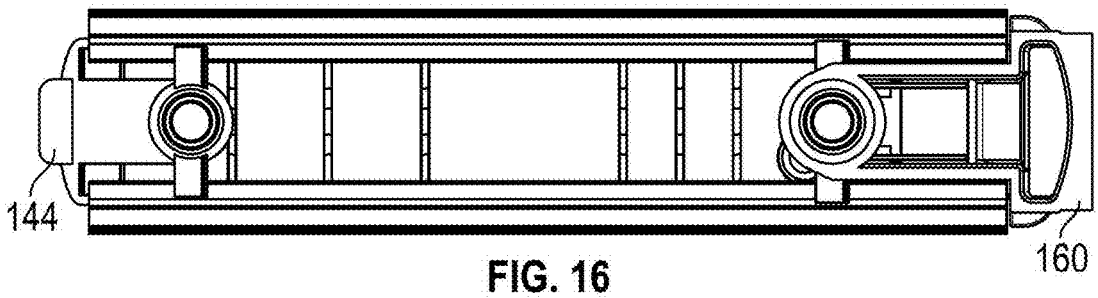
FIG. 16 is a partial bottom view of the hair straightening appliance of FIG. 1 with the second heating plate in the fixed configuration.
Figure 18:
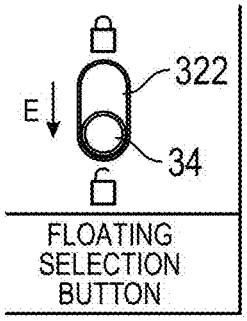
FIG. 18 is an enlarged view of the floating selection switch assembly of the hair straightening appliance of FIG. 1 in a floating setting location.

The user can selectively move floating selection switch assembly 34 between two positions the fixed setting location shown in FIG. 9 and the floating setting position shown in FIG. 18. Referring to FIG. 9, floating selection switch assembly 34 is shown in a fixed setting location positioning second heating plate 14 in a fixed in configuration. Appliance 10 can include indicia 700 to indicate floating selection switch assembly 34 is in the fixed setting location and indicia 702 to indicate floating selection switch assembly 34 is in the floating setting location. Referring to FIGS. 10-13, front insulator 144 is connected to second housing 28, for example, by front connection portion 182 of front insulator 144 fitting in second housing 28 by mechanical, friction or snap fit, so that front tab 184 is moveable toward and away from second housing 28. Referring to FIG. 11, second heating plate assembly 26 has front floating flexible cover 146 positioned on front protuberance 190 and front floating spring 148 positioned around front circular wall 192. Front floating flexible cover 146 and front floating spring 148 pass through forward opening 168 so that they are positioned through sliding block 150. Fastener 152 passes through forward track opening 170 of sliding block 150 and connects to second housing 28 in receptacle 138 connecting sliding block 150 to second housing 28 so that sliding block 150 can slide along forward track opening 170. Extension 142 of second housing 28 extends through forward track opening 170 of sliding block 150. Selection fastener 156 passes through detent spring 158 and is secured in receptacle 172 of sliding block 150. As shown in FIG. 14, detent spring 158 is secured around selection fastener 156 and extension 142 and rests on a support tab 342 in the fixed setting location. Referring back to FIG. 11, fastener 154 passes through rear track opening 174 of sliding block 150 and connects to second housing 28 in receptacle 140 connecting sliding block 150 to second housing 28 so that sliding block 150 can slide along rear track opening 174. Rear connection portion 198 of rear insulator 160 connects to second edge 315 of second support 30, for example, by mechanical, friction or snap fit, so that rear tab 300 is moveable toward and away from second housing 28. Rear floating flexible cover 162 is positioned on the rear protuberance 161 and rear floating spring 164 is positioned around rear circular wall 308. Rear floating flexible cover 162 and rear floating spring 164 pass through rear opening 176 so that they are positioned through sliding block 150. Rod 336 of floating selection switch assembly 34 extends through cam slot 180 of sliding block 150 and floating selection switch 35, decoration ring 332, switch 334 and rod 336 extends through second support opening 322 of second support 30. Second heating plate 14 is connected to front insulator 144 by opposing second L-shaped members 313*a*, 313*b* fitting on front posts 186, 188 and connected to rear insulator 160 on opposite sides by opposing second L-shaped members 313*a*, 313*b* fitting on rear post 302. Second heating plate 14 can be connected to a ceramic heater 712 that is connected to a heater plate 714 and a heater spring 716 that can rest on opposing second L-shaped members 313*a*, 313*b*. First heating plate 12 that is fixed on first housing 22 can have a similar ceramic heater, heater plate and heater spring similar to second heating plate 14.

Figure 15:
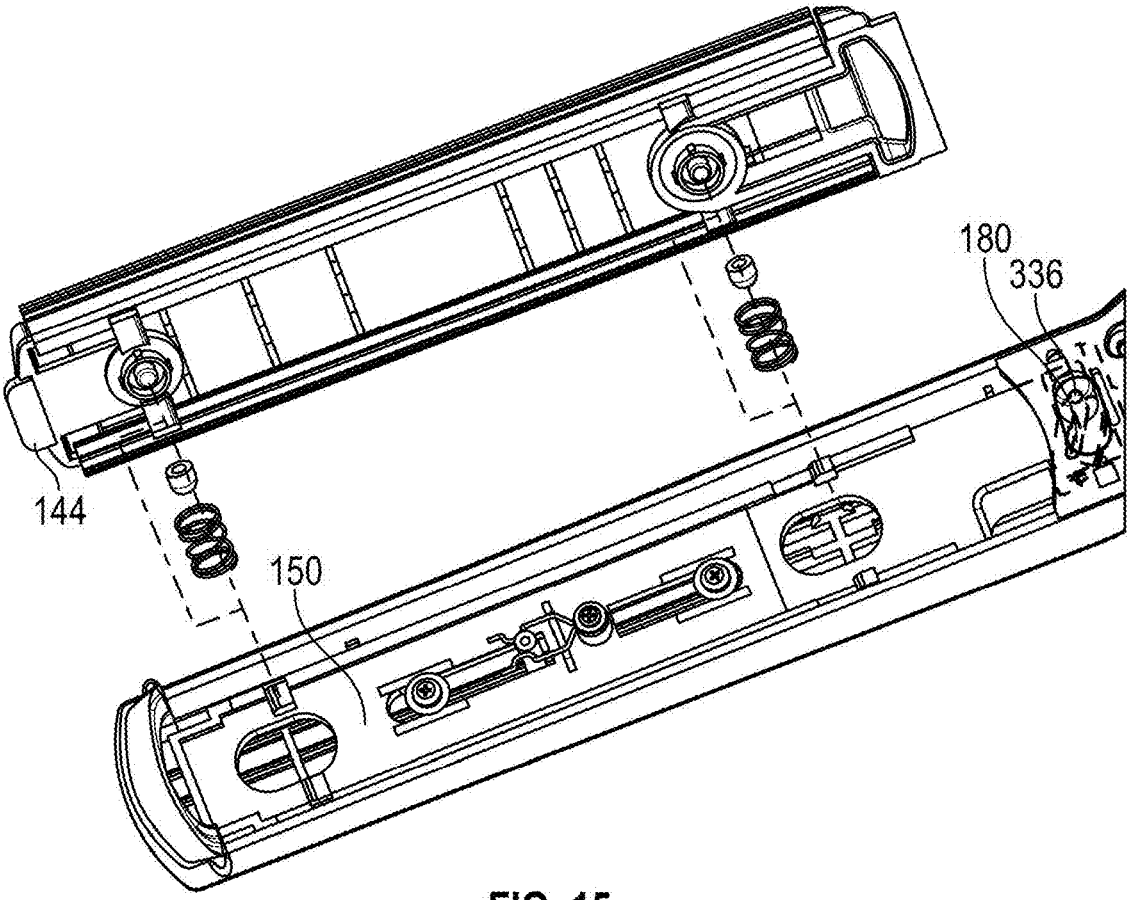
FIG. 15 is a partial exploded, side perspective view of the hair straightening appliance of FIG. 1 with the second heating plate in the fixed configuration.

Referring to FIG. 15, since rod 336 of floating selection switch assembly 34 extends through cam slot 180 of sliding block 150, movement of floating selection switch assembly 34 moves sliding block 150 between two positions: the fixed setting location shown in FIGS. 9-17, and the floating setting location shown in FIGS. 18-26. Accordingly, appliance 10 has two total settings.

Figure 17:
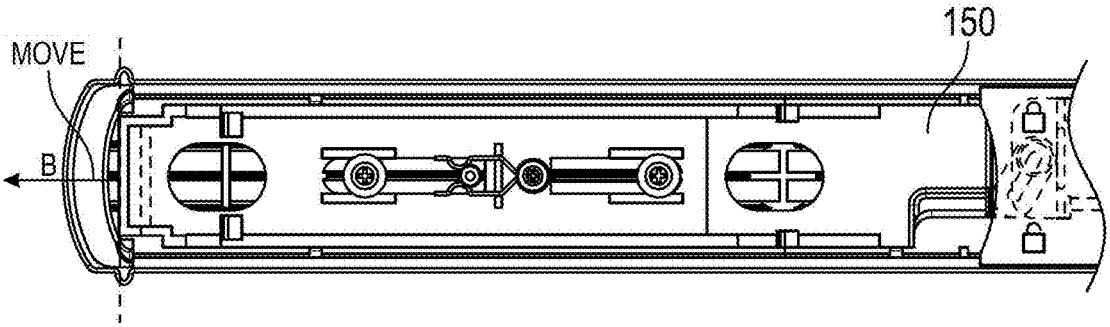
FIG. 17 is a partial, top view of the hair straightening appliance of FIG. 1 with the second heating plate in the fixed configuration and with the second heating plate removed.

As floating selection switch assembly 34 is moved horizontally to the fixed setting location from the floating setting location, shown by arrow A in FIG. 9, rod 336 moves in cam slot 180, as shown in FIG. 17, to move or slide sliding block 150 towards front insulator 144, as shown by arrow B in FIG. 17. When appliance 10 is in the fixed setting location, as shown in FIGS. 12 and 13, each of front rigid bosses 166*a*, 166*b* of sliding block 150 are each aligned with one of front rigid bosses 194, 196 of front insulator 144 and each of rear rigid bosses 178*a*, 178*b* of sliding block 150 are each aligned with one of rear rigid bosses 310, 312 of rear insulator 160 so that movement of front tab 184 of front insulator 144 and movement of rear tab 300 of rear insulator 160 toward second housing 28 is limited or prevented maintaining second heating plate 14 in a fixed position. Referring to FIG. 14, detent spring 158 is moved with sliding block 150 to be positioned around extension 142 of second housing 28 to maintain appliance 10 in the fixed setting location.

Figures 21, 22:
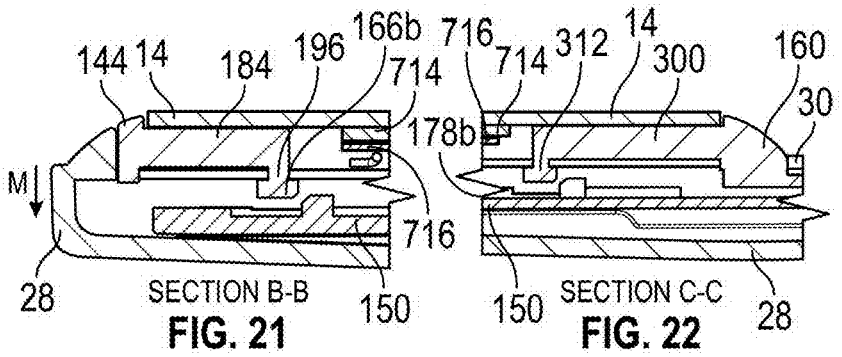
FIG. 21 is a partial, side cross-sectional view taken along line B-B of FIG. 19 of the hair straightening appliance of FIG. 1 with the second heating plate in the floating configuration.
FIG. 22 is a partial, side cross-sectional view taken along line C-C of FIG. 19 of the hair straightening appliance of FIG. 1 with the second heating plate in the floating configuration.
Figure 19:
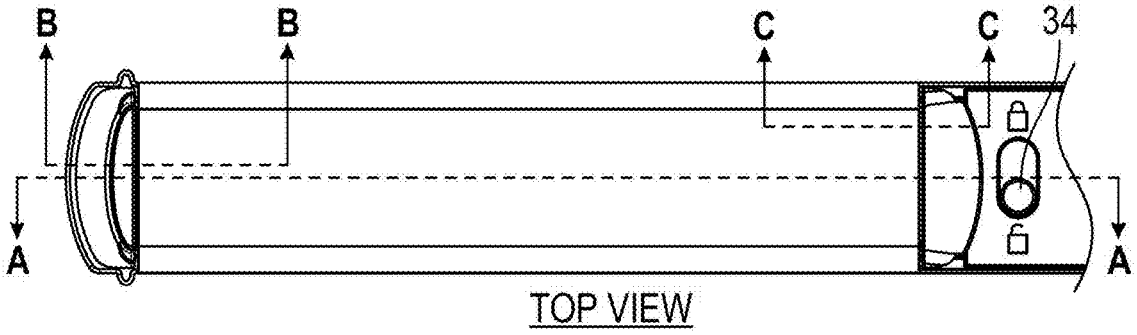
FIG. 19 is a partial, top view of the hair straightening appliance of FIG. 1 with the second heating plate in the floating configuration.
Figure 23:
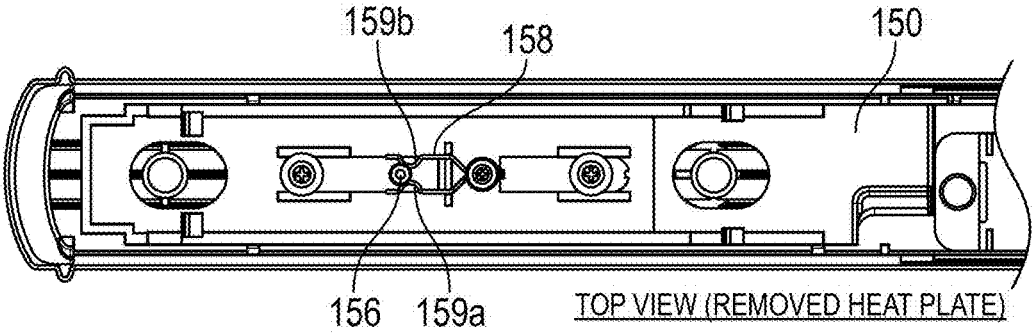
FIG. 23 is a partial, top view of the hair straightening appliance of FIG. 19 with the second heating plate in the floating configuration and with the second heating plate removed.
Figure 25:
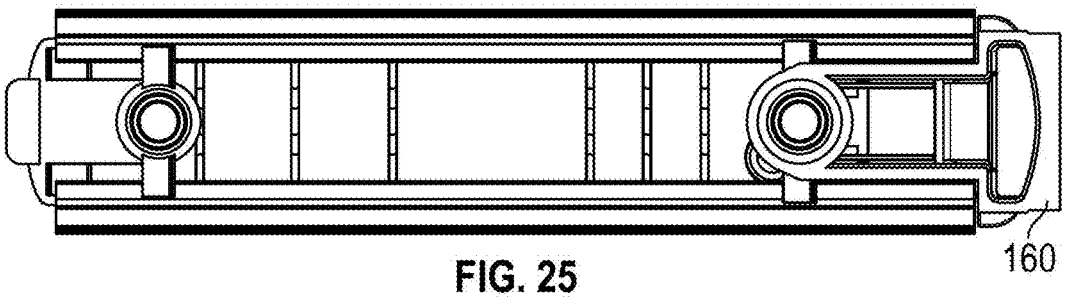
FIG. 25 is a partial bottom view of the hair straightening appliance of FIG. 1 with the second heating plate in the floating configuration.
Figure 24:
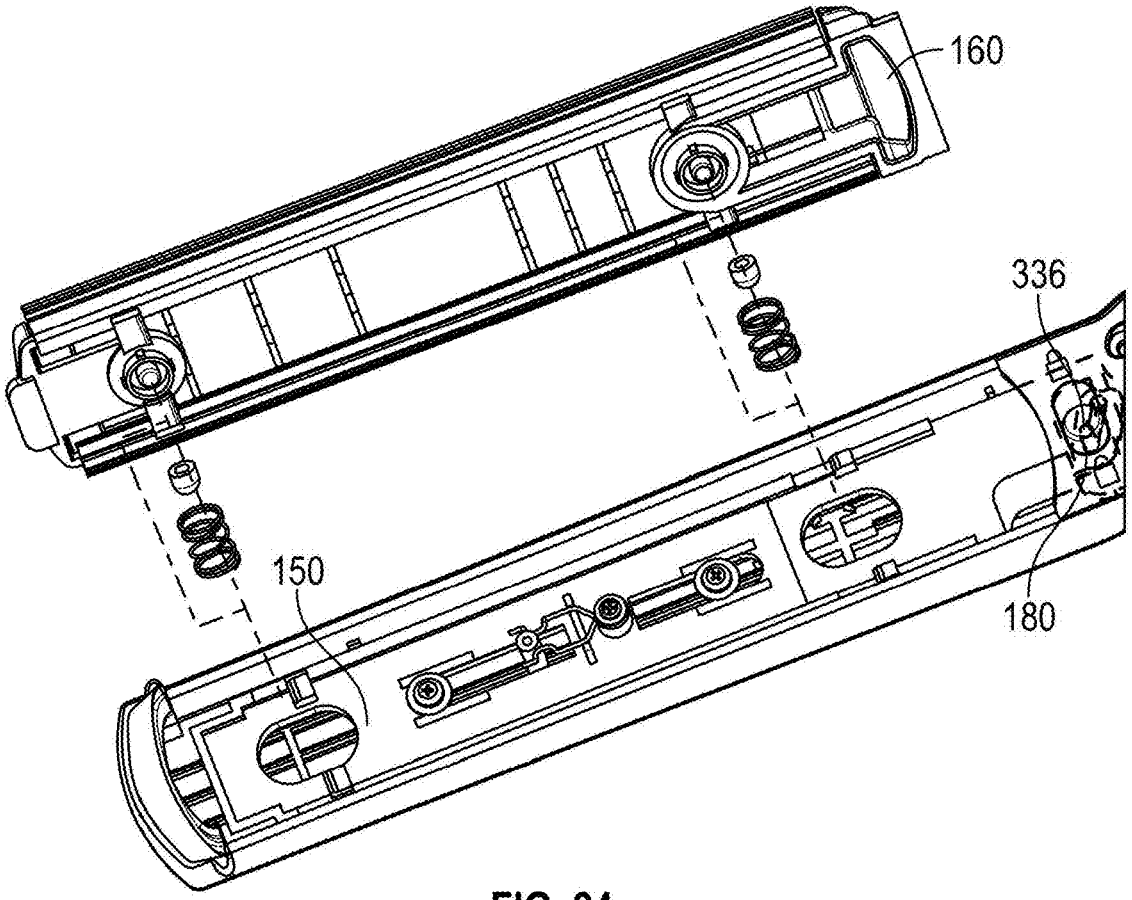
FIG. 24 is a partial exploded, side perspective view of the hair straightening appliance of FIG. 1 with the second heating plate in the floating configuration.
Figure 26:
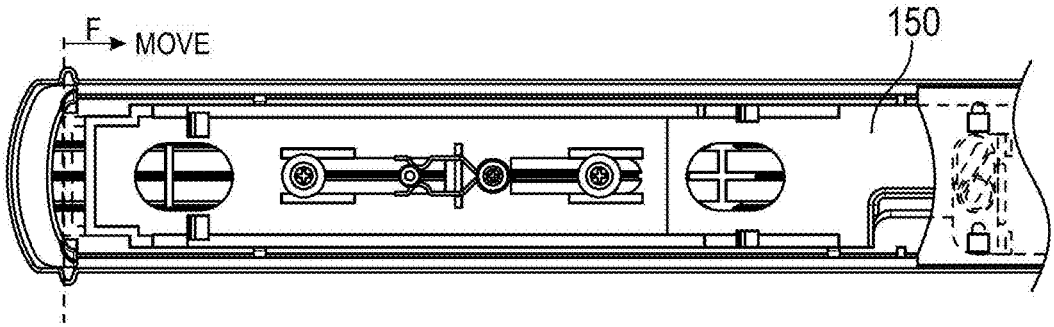
FIG. 26 is a partial, top view of the hair straightening appliance of FIG. 1 with the second heating plate in the floating configuration and with the second heating plate removed.

Referring to FIGS. 18 and 19, as floating selection switch assembly 34 is moved horizontally to the floating setting location, shown by arrow E in FIG. 18, from the fixed setting location, rod 336 moves in cam slot 180, as shown in FIG. 26, to move or slide sliding block 150 towards rear insulator 160, as shown by arrow F in FIG. 26, to the floating configuration. When appliance 10 is in the floating configuration, as shown in FIGS. 21 and 22, each of front rigid bosses 194, 196 of front insulator 144 are no longer aligned with front rigid bosses 166*a*, 166*b* of sliding block 150, and, instead front rigid bosses 194, 196 of front insulator 144 are aligned with a front portion of sliding block 150. Front portion of sliding block 150 has a thickness that is less than the portion of sliding block 150 having front rigid bosses 166*a*, 166*b* and each of rear rigid bosses 310, 312 of rear insulator 160 are no longer aligned with rear rigid bosses 178*a*, 178*b* of sliding block 150. Instead rear rigid bosses 310, 312 of rear insulator 160 are aligned with a rear portion of sliding block 150 that has a thickness that is less than the portion of sliding block 150 having rear rigid bosses 178*a*, 178*b* so that both front tab 184 of front insulator 144 and rear tab 300 of rear insulator 160 are movable toward and away from second housing 28 allowing second heating plate 14 to move or float. Referring to FIG. 23, detent spring 158 is moved with sliding block 150 to be positioned so that protrusions 159*a*, 159*b* of detent spring 158 extend on a side of selection fastener 156 to maintain appliance 10 in the floating configuration.

In use, first handle 16 and second handle 18 are selectively moved from a closed position where first heating plate 12 and second heating plate 14 are adjacent to each other, as shown in FIG. 1, to an open position where first heating plate 12 and second heating plate 14 are spaced from one another to receive a user's hair. First handle 16 and second handle 18 can be biased toward the open position so that the user can selectively move first handle 16 and second handle 18 from the open position to the closed position during use. One or more buttons 36 can provide inputs to controller 143, for example, to turn appliance 10 on and off, adjust heat, and the like.

The user can selectively move floating selection switch assembly 34 to the fixed setting location shown in FIGS. 9-17, or the floating setting position shown in FIGS. 18-26. When floating selection switch assembly 34 is in the fixed setting location shown in FIGS. 9-17, the user places a section of the user's hair between first heating plate 12 and second heating plate 14 and moves first handle 16 toward second handle 18 to clamp the user's hair between first heating plate 12 and second heating plate 14. While the user's hair is between first heating plate 12 and second heating plate 14 heat is applied for straightening. Power cord 20 can conduct electric current to controller 143, ceramic heater 712, ceramic heater for first heating plate 12 and the like. Also, while the user's hair between first heating plate 12 and second heating plate 14, a first force is applied to second heating plate 14 in direction H shown in FIG. 12 thereby applying a force in direction H to front insulator 144 so that front rigid bosses 194, 196 each contact one of second front rigid bosses 166*a*, 166*b* of sliding block 150 and applying a force in direction H to rear insulator 160 so that rear rigid bosses 310, 312 each contact one of rear rigid bosses 178*a*, 178*b* of sliding block 150 that limit or prevent movement of second heating plate 14 toward second housing 28 during use in the fixed setting location. First handle 16 and second handle 18 can then be moved away from one another and the user's hair removed from appliance 10.

Figure 20:
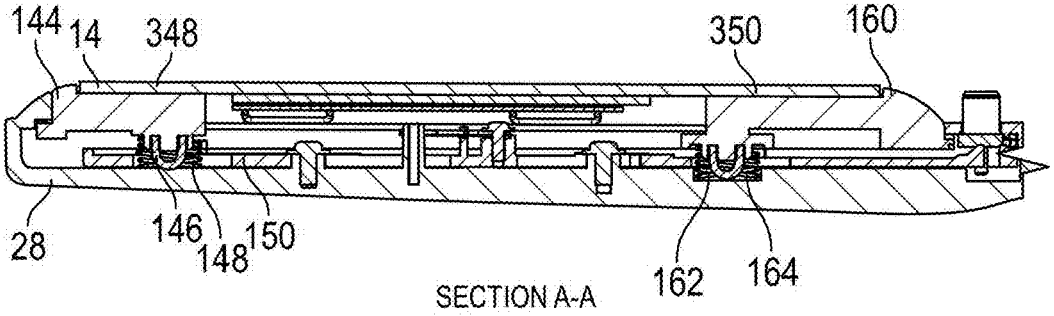
FIG. 20 is a partial, side cross-sectional view taken along line A-A of FIG. 19 of the hair straightening appliance of FIG. 1 with the second heating plate in the floating configuration.

When floating selection switch assembly 34 is in the floating setting location shown in FIGS. 18-26, the user places a section of the user's hair between first heating plate 12 and second heating plate 14 and moves first handle 16 toward second handle 18 to clamp the user's hair between first heating plate 12 and second heating plate 14. While the user's hair is between first heating plate 12 and second heating plate 14 heat is applied for straightening. As shown in FIG. 21, while the user's hair is between first heating plate 12 and second heating plate 14, a force is applied in direction M to second heating plate 14 and front insulator 144. Since front rigid bosses 194, 196 are no longer aligned with front rigid bosses 166*a*, 166*b* of sliding block 150, as shown in FIG. 20, front floating flexible cover 146 and front floating spring 148 are compressed between front insulator 144 and second housing 28 allowing movement or floating of front portion 348 of second heating plate 14 toward second housing 28 during use in the floating configuration. As shown in FIG. 22, when the force is applied in direction M to second heating plate 14 and rear insulator 160, rear rigid bosses 310, 312 are also no longer aligned with rear rigid bosses 178*a*, 178*b* of sliding block 150 so, as shown in FIG. 20, rear floating flexible cover 162 and rear floating spring 308 are compressed between rear insulator 160 and second housing 28 allowing movement or floating of a rear portion 350 of second heating plate 14 toward second housing 28. When the forces in the direction M are released, then a bias of front floating flexible cover 146, front floating spring 148, rear floating flexible cover 162 and rear floating spring 308 move second heating plate 14 away from second housing 28 and first handle 16 and second handle 18 can be moved away from one another and the user's hair removed from appliance 10.

Referring to FIG. 27, appliance 10 of FIG. 8 is modified to include a first heating plate 12 that is adjustable. As shown in FIG. 27, first handle 16 has receptacles 138, 140, and an extension 142 that each extend from first housing 22. First support 24 has a first forward curved portion 114 at one end, a first rear curved portion 116 at the opposite end and first middle support portion 118 therebetween. First curved portion 114 has a first edge 115. First support 24 has a first support opening 120 through first forward curved portion 114, first middle apertures 122, 123, 124, 125 through middle support portion 118, first rear apertures 126, 128 through first rear curved portion 116, and a first rotation aperture 130 through each side of first rear curved portion 116. First support 24 is connected to first housing 22, for example, by fasteners that pass through one or more of first middle apertures 122, 123, 124, 125, first rear apertures 126, 128 and one or more receptacles in first housing 22. As discussed earlier, first support 24 that is connected to first housing 22 is rotatably connected to second support 30 that is connected to second housing 28 by first rear curved portion 116 that is positioned in between circular members 320*a*, 320*b* so that a fastener is passed through first rotation apertures 130 through each side of first rear curved portion 116 and second rotation opening 330 in each of circular members 320*a*, 320*b* forming tongs. A biasing member biasing first housing 22 away from second housing 28 may also be included in the rotatable connection between first support 24 and second support 30.

First heating plate assembly 26 is the same as second heating plate assembly 32. In particular, first heating plate assembly 26 has first heating plate 12 that is the same as second heating plate 14, front insulator 144, front floating flexible cover 146, front floating spring 148, sliding block 150, fasteners 152 and 154, selection fastener 156, detent spring 158, rear insulator 160, rear floating flexible cover 162, and rear floating spring 164. Front insulator 144 is connected to first housing 22, for example, by front connection portion 182 of front insulator 144 fitting in first housing 22 by mechanical, friction or snap fit, so that front tab 184 is moveable toward and away from first housing 22. First heating plate assembly 24 has front floating flexible cover 146 positioned on front protuberance 190 and front floating spring 148 positioned around front circular wall 192. Front floating flexible cover 146 and front floating spring 148 pass through forward opening 168 so that they are positioned through sliding block 150. Fastener 152 passes through forward track opening 170 of sliding block 150 and connects to first housing 22 in receptacle 138 connecting sliding block 150 to first housing 22 so that sliding block 150 can slide along forward track opening 170. Extension 142 of first housing 22 extends through forward track opening 170 of sliding block 150. Selection fastener 156 passes through detent spring 158 and is secured in receptacle 172 of sliding block 150. Detent spring 158 is secured around selection fastener 156 and extension 142 and rests on support tab 342 in the fixed setting location of the second floating selection switch assembly 34. Fastener 154 passes through rear track opening 174 of sliding block 150 and connects to first housing 22 in receptacle 140 connecting sliding block 150 to first housing 22 so that sliding block 150 can slide along rear track opening 174. Rear connection portion 198 of rear insulator 160 connects to first edge 115 of first support 24, for example, by mechanical, friction or snap fit, so that rear tab 300 is moveable toward and away from first housing 22. Rear floating flexible cover 162 is positioned on the rear protuberance 161 and rear floating spring 164 is positioned around rear circular wall 308. Rear floating flexible cover 162 and rear floating spring 164 pass through rear opening 176 so that they are positioned through sliding block 150. Rod 336 of the second floating selection switch assembly 34 extends through cam slot 180 of sliding block 150 and floating selection switch 35, decoration ring 332, switch 334 and rod 336 extends through first support opening 120 of first support 24. First heating plate 12 is connected to front insulator 144 by opposing second L-shaped members 313*a*, 313*b* fitting on front posts 186, 188 and connected to rear insulator 160 on opposite sides by opposing second L-shaped members 313*a*, 313*b* fitting on rear post 302. First heating plate 12 can be connected to another ceramic heater 712 that is connected to another heater plate 714 and another heater spring 716 that can rest on opposing L-shaped members 313*a*, 313*b* of first heating plate 12.

The operation of adjusting first heating plate 12 between the fixed configuration and the floating configuration is the same as the operation of adjusting second heating plate 14 between the fixed configuration and the floating configuration described above and shown in FIGS. 8-26. In particular, as the second floating selection switch assembly 34 is moved horizontally to the fixed setting location from the floating setting location rod 336 moves in cam slot 180 to move or slide sliding block 150 towards front insulator 144. When the second floating selection switch assembly 34 is in the fixed setting location each of front rigid bosses 166*a*, 166*b* of sliding block 150 are each aligned with one of front rigid bosses 194, 196 of second front insulator 144 and each of rear rigid bosses 178*a*, 178*b* of sliding block 150 are each aligned with one of rear rigid bosses 310, 312 of rear insulator 160 so that movement of front tab 184 of front insulator 144 and movement of rear tab 300 of rear insulator 160 toward first housing 22 is limited or prevented maintaining first heating plate 12 in a fixed position. Detent spring 158 is moved with sliding block 150 to be positioned around extension 142 of first housing 22 to maintain the second floating selection switch assembly 34 in the fixed setting location.

As the second floating selection switch assembly 34 is moved horizontally to the floating setting location from the fixed setting location, rod 336 moves in cam slot 180 to move or slide sliding block 150 towards rear insulator 160 to the floating configuration. When the second floating selection switch assembly 34 is in the floating setting location, each of front rigid bosses 194, 196 of front insulator 144 are no longer aligned with front rigid bosses 166*a*, 166*b* of sliding block 150, and, instead front rigid bosses 194, 196 of front insulator 144 are aligned with a front portion of sliding block 150. Front portion of sliding block 150 has a thickness that is less than the portion of sliding block 150 having front rigid bosses 166*a*, 166*b* and each of rear rigid bosses 310, 312 of rear insulator 160 are no longer aligned with rear rigid bosses 178*a*, 178*b* of sliding block 150. Instead rear rigid bosses 310, 312 of rear insulator 160 are aligned with a rear portion of sliding block 150 that has a thickness that is less than the portion of sliding block 150 having rear rigid bosses 178*a*, 178*b* so that both front tab 184 of front insulator 144 and rear tab 300 of rear insulator 160 are movable allowing first heating plate 12 to move or float. Detent spring 158 is moved with sliding block 150 to be positioned so that protrusions 159*a*, 159*b* of detent spring 158 extend on a side of selection fastener 156 to maintain the second floating selection switch assembly 34 in the floating setting location.

In use, first handle 16 and second handle 18 are selectively moved from a closed position where first heating plate 12 and second heating plate 14 are adjacent to each other to an open position where first heating plate 12 and second heating plate 14 are spaced from one another to receive a user's hair. First handle 16 and second handle 18 can be biased toward the open position so that the user can selectively move first handle 16 and second handle 18 from the open position to the closed position during use. One or more buttons 36 can provide inputs to controller 143, for example, to turn appliance 10 on and off, adjust heat, and the like.

During use, the user can selectively move the second floating selection switch assembly 34 to the fixed setting location or the floating setting position, so that first heating plate 12 can be in the fixed configuration or the floating configuration. When the second floating selection switch assembly 34 of first heating plate 12 is in the fixed setting location, the user places a section of the user's hair between first heating plate 12 and second heating plate 14 and moves first handle 16 toward second handle 18 to clamp the user's hair between first heating plate 12 and second heating plate 14. While the user's hair is between first heating plate 12 and second heating plate 14 heat is applied for straightening. Also, while the user's hair between first heating plate 12 and second heating plate 14, a first force is applied to first heating plate 12 in direction opposite direction H shown in FIG. 12 thereby applying a force in the opposite direction to direction H to front insulator 144 so that front rigid bosses 194, 196 each contact one of second front rigid bosses 166*a*, 166*b* of sliding block 150 and applying a force in the opposite direction to direction H to rear insulator 160 so that rear rigid bosses 310, 312 each contact one of rear rigid bosses 178*a*, 178*b* of sliding block 150 that limit or prevent movement of first heating plate 12 toward first housing 22 during use in the fixed setting location. Floating selection switch assembly 34 of second heating plate 14 can be in the fixed setting location or the floating setting location during use as described above while the second floating selection switch assembly 34 of first heating plate 12 is in the fixed setting location. First handle 16 and second handle 18 can then be moved away from one another and the user's hair removed from appliance 10.

When the second floating selection switch assembly 34 of first heating plate 12 is in the floating setting location, the user places a section of the user's hair between first heating plate 12 and second heating plate 14 and moves first handle 16 toward second handle 18 to clamp the user's hair between first heating plate 12 and second heating plate 14. While the user's hair is between first heating plate 12 and second heating plate 14 heat is applied for straightening. Also, while the user's hair is between first heating plate 12 and second heating plate 14, a force is applied in an opposite direction to direction M to first heating plate 12 and front insulator 144. However, front rigid bosses 194, 196 are no longer aligned with front rigid bosses 166*a*, 166*b* of sliding block 150 so front floating flexible cover 146 and front floating spring 148 are compressed between front insulator 144 and first housing 22 allowing movement or floating of first heating plate 12 toward first housing 22 during use in the floating configuration. When the force is applied in the opposite direction to direction M to first heating plate 12 and rear insulator 160, rear rigid bosses 310, 312 are no longer aligned with rear rigid bosses 178*a*, 178*b* of sliding block 150 so rear floating flexible cover 162 and rear floating spring 308 are compressed between rear insulator 160 and first housing 22 allowing movement or floating of first heating plate 12 toward first housing 22. Floating selection switch assembly 34 of second heating plate 14 can be in the fixed setting location or the floating setting location during use as described above while the second floating selection switch assembly 34 of first heating plate 12 is in the floating setting location. When the forces in the opposite direction to direction M are released, then a bias of front floating flexible cover 146, front floating spring 148, rear floating flexible cover 162 and rear floating spring 308 move first heating plate 12 away from first housing 22 and first handle 16 and second handle 18 can be moved away from one another and the user's hair removed from appliance 10.

Referring to FIG. 28, appliance 10 of FIG. 8 is modified to include the first heating plate 12 that is adjustable as shown in as FIG. 27 and second heating plate 14 is non-adjustable. Second heating plate 14 of FIG. 28 is non-adjustable in the front fixed and rear floating configuration as shown in FIGS. 42 and 43. Alternatively, second heating plate 14 is non-adjustable in the fixed configuration or second heating plate 14 is non-adjustable in the floating configuration. Accordingly, floating selection switch assembly 34 on second handle 18 can be omitted Second heating plate 14 can still be heated by ceramic heater 712 that is connected to heater plate 714 and heater spring 716. The second floating selection switch assembly 34 of first heating plate 12 can be in the fixed setting location or the floating setting location during use as described above while second heating plate 14 non-adjustably remains in the front fixed and rear floating configuration on second housing 28 during use.

Figure 29:
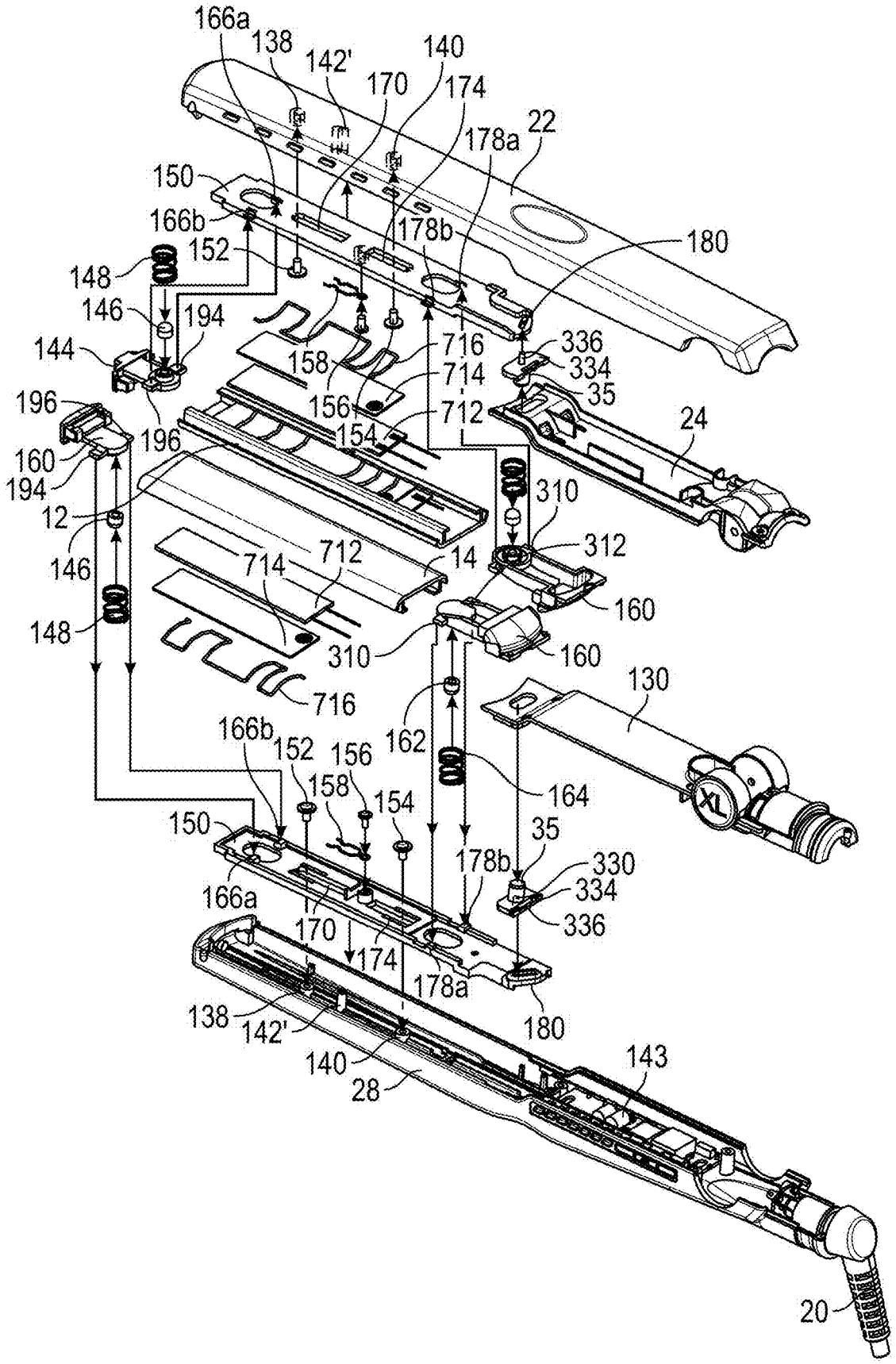
FIG. 29 is an exploded, side perspective view of the hair straightening appliance of FIG. 1 modified to include the first heating plate that is adjustable of FIG. 27 and further modified to include three settings for each of the first heating plate and the second heating plate.
Figure 33:
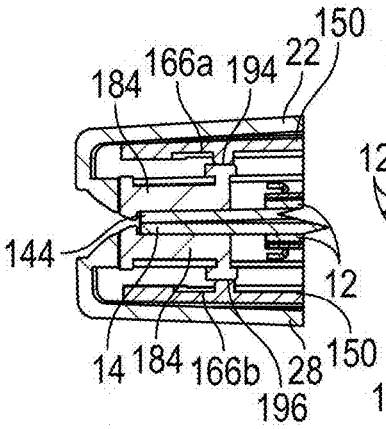
FIG. 33 is a partial, side cross-sectional view taken along line B-B of FIG. 31 of the hair straightening appliance of FIG. 29 with the first heating plate and the second heating plate in the full fixed configuration.
Figure 34:
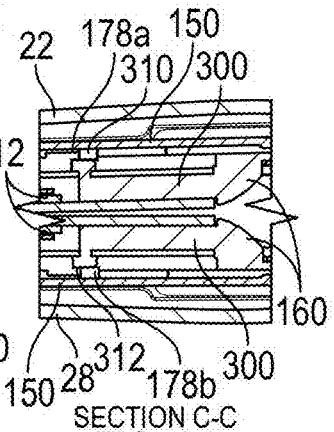
FIG. 34 is a partial, side cross-sectional view taken along line C-C of FIG. 31 of the hair straightening appliance of FIG. 29 with the first heating plate and the second heating plate in the full fixed configuration.
Figure 31:
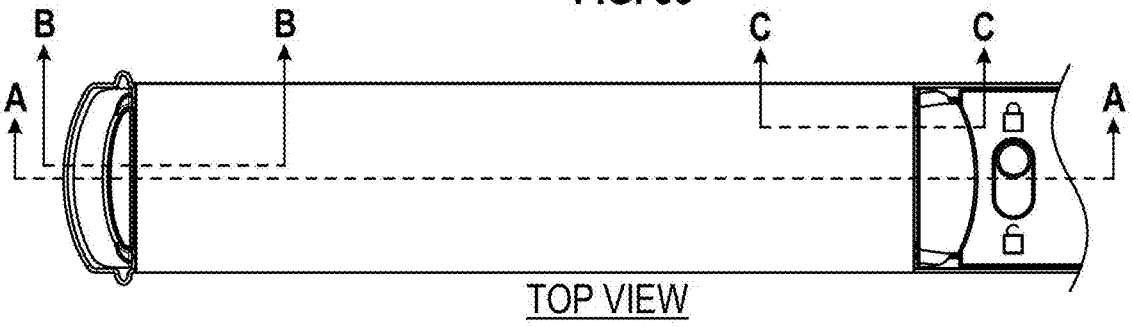
FIG. 31 is a partial, top view of the hair straightening appliance of FIG. 29 with the first heating plate and the second heating plate in a full fixed configuration.
Figure 35:
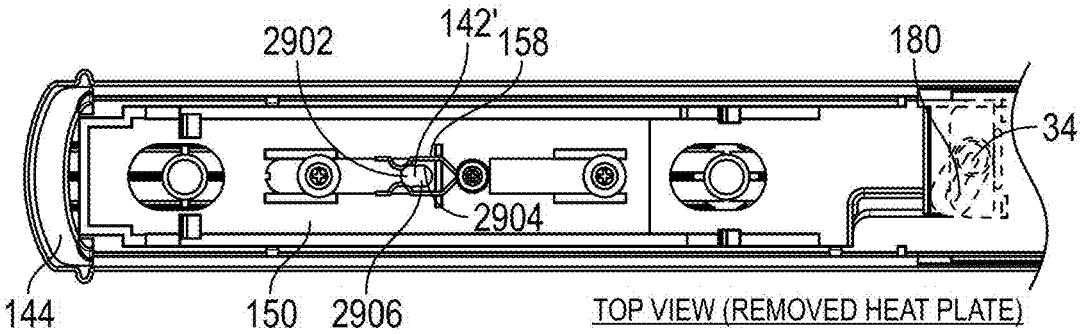
FIG. 35 is a partial, top view of the hair straightening appliance of FIG. 29 with the first heating plate and the second heating plate in the full fixed configuration and with the second heating plate removed.

Referring to FIG. 29, appliance 10 of FIG. 8 is modified to include first heating plate 12 of FIG. 27 that is adjustable and further to include three settings instead of the two settings for each of first heating plate 12 and second heating plate 14. The three settings of FIGS. 29-56 include a full fixed setting location as shown in FIGS. 30-38, a front fixed and rear floating setting location as shown in FIGS. 39-47, and a full floating setting location as shown in FIGS. 48-56. Referring to FIG. 29, appliance 10 is the same as shown in FIG. 8 except extension 142 of second housing 28 is modified to extension 142' that has a different shape. In particular, as shown in FIG. 35, extension 142' has grooves 2902, 2904 on opposite sides of extension body 2906. Similarly, first heating plate 12 that is adjustable is the same as show in FIG. 27 except extension 142 of first housing 22 is modified to extension 142'.

Figure 30:
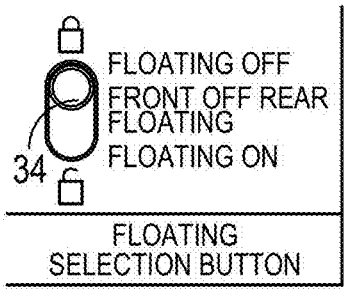
FIG. 30 is an enlarged view of a floating selection switch assembly of the hair straightening appliance of FIG. 29 in a full fixed setting location.
Figure 32:
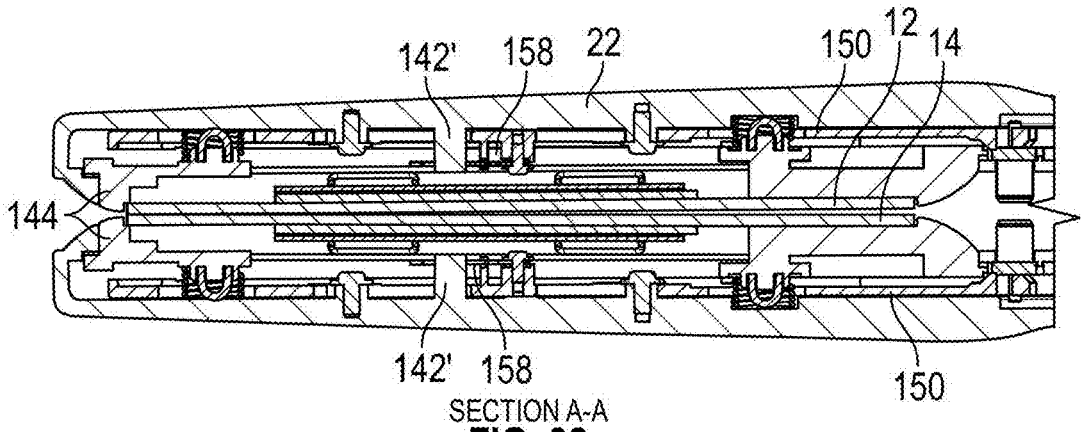
FIG. 32 is a partial, side cross-sectional view taken along line A-A of FIG. 31 of the hair straightening appliance of FIG. 29 with the first heating plate and the second heating plate in the full fixed configuration.
Figure 37:
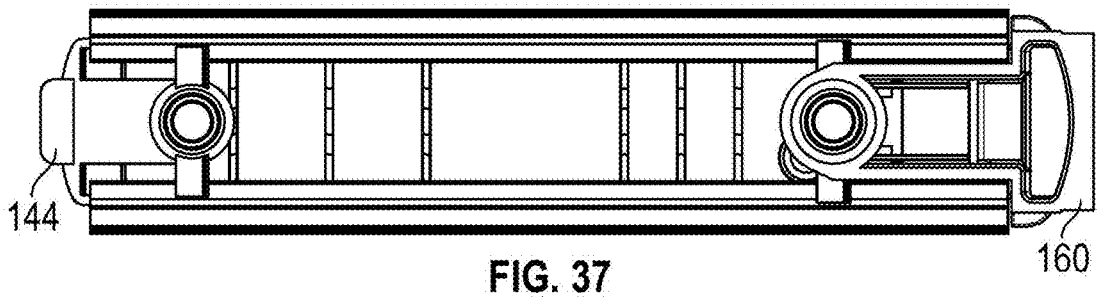
FIG. 37 is a partial bottom view of the hair straightening appliance of FIG. 29 with the first heating plate and the second heating plate in the full fixed configuration.
Figure 36:
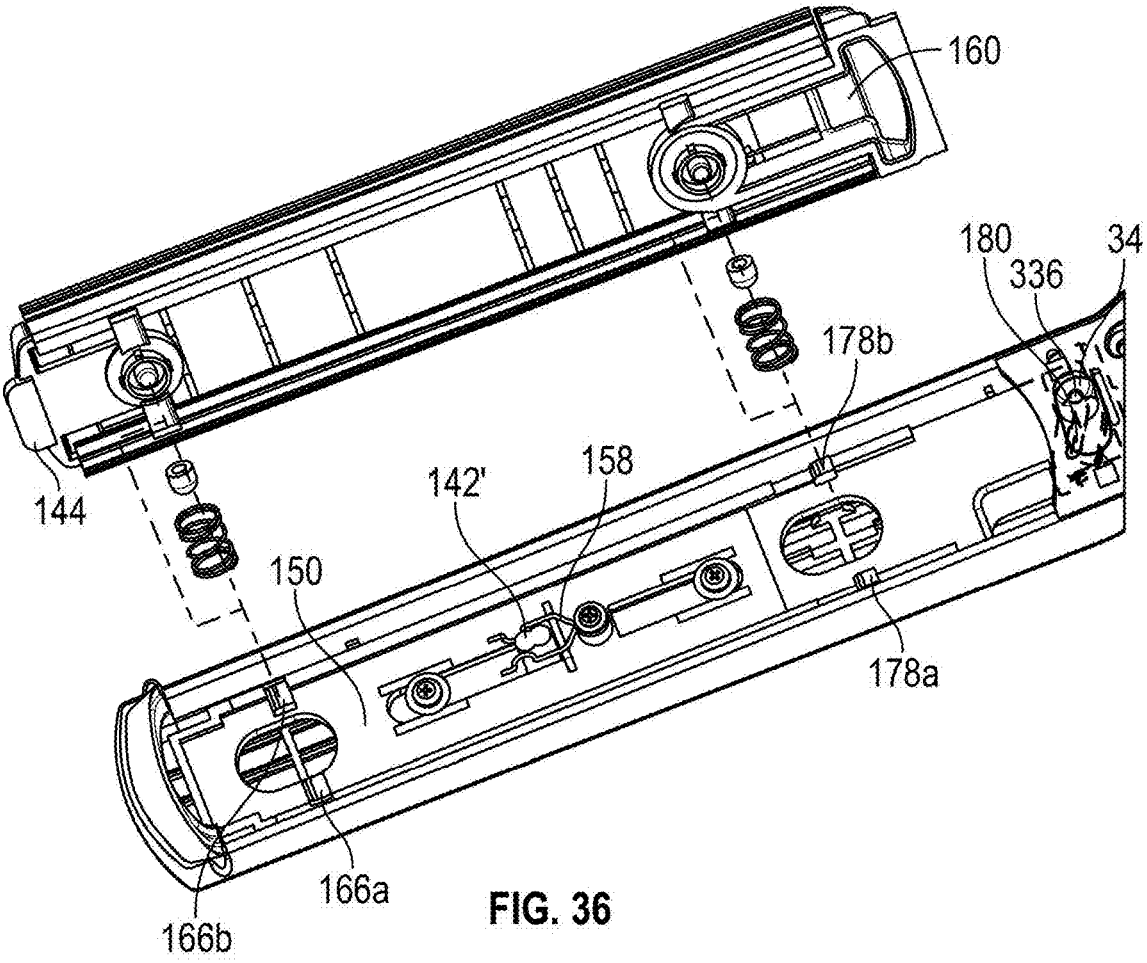
FIG. 36 is a partial exploded, side perspective view of the hair straightening appliance of FIG. 29 with the first heating plate and the second heating plate in the full fixed configuration.
Figure 38:
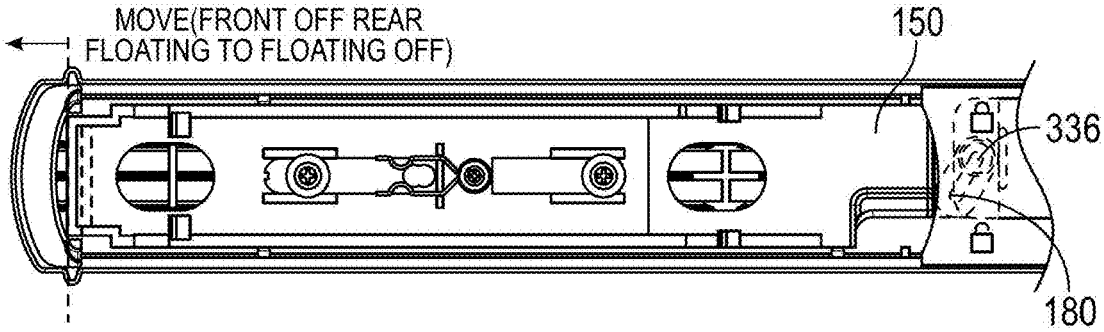
FIG. 38 is a partial, top view of the hair straightening appliance of FIG. 29 with the first heating plate and the second heating plate in the full fixed configuration and with the second heating plate removed.

Referring to FIGS. 30 and 32, as the second floating selection switch assembly 34 of first heating plate 12 is moved horizontally to the full fixed setting location from the front fixed and rear floating setting location, as shown in FIGS. 36 and 37, rod 336 moves in cam slot 180 to move or slide sliding block 150 towards front insulator 144. When the second floating selection switch assembly 34 of first heating plate 12 is in the full fixed setting location, as shown in FIG. 33, each of front rigid bosses 166*a*, 166*b* of sliding block 150 are each aligned with one of front rigid bosses 194, 196 of second front insulator 144 and, as shown in FIG. 34, each of rear rigid bosses 178*a*, 178*b* of sliding block 150 are each aligned with one of rear rigid bosses 310, 312 of rear insulator 160 so that movement of front tab 184 of front insulator 144 and movement of rear tab 300 of rear insulator 160 toward first housing 22 is limited or prevented maintaining first heating plate 12 in a fixed configuration as shown in FIG. 32. Detent spring 158 is moved with sliding block 150 to be positioned around extension 142' of first housing 22 to maintain the second floating selection switch assembly 34 in the fixed setting location.

Similarly, as shown in FIGS. 30 and 32, as floating selection switch assembly 34 of second heating plate 14 is moved horizontally to the full fixed setting location from the front fixed and rear floating location rod 336 moves in cam slot 180 to move or slide sliding block 150 towards front insulator 144. When floating selection switch assembly 34 is in the fixed setting location, as shown in FIG. 33, each of front rigid bosses 166*a*, 166*b* of sliding block 150 are each aligned with one of front rigid bosses 194, 196 of second front insulator 144 and each of rear rigid bosses 178*a*, 178*b* of sliding block 150 are each aligned with one of rear rigid bosses 310, 312 of rear insulator 160 so that movement of front tab 184 of front insulator 144 and movement of rear tab 300 of rear insulator 160 toward second housing 28 is limited or prevented maintaining second heating plate 14 in a fixed configuration as shown in FIG. 32. As shown in FIG. 35-38, detent spring 158 is moved with sliding block 150 to be positioned around extension 142' of second housing 28 to maintain floating selection switch assembly 34 in the fixed setting location.

Figure 39:
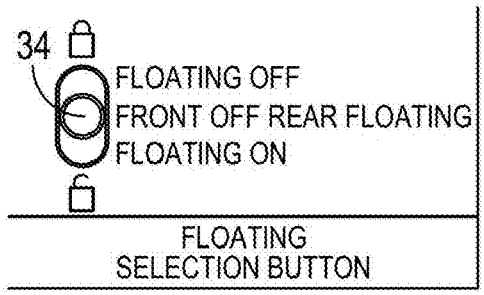
FIG. 39 is an enlarged view of the floating selection switch assembly of the hair straightening appliance of FIG. 29 in a front fixed and rear floating setting location.
Figure 41:
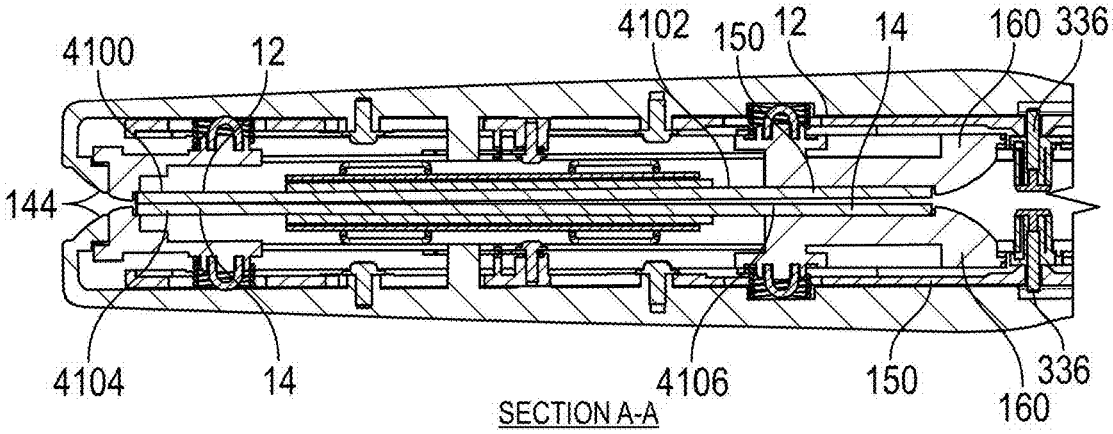
FIG. 41 is a partial, side cross-sectional view taken along line A-A of FIG. 40 of the hair straightening appliance of FIG. 29 with the first heating plate and the second heating plate in the front fixed and rear floating configuration.
Figure 44:
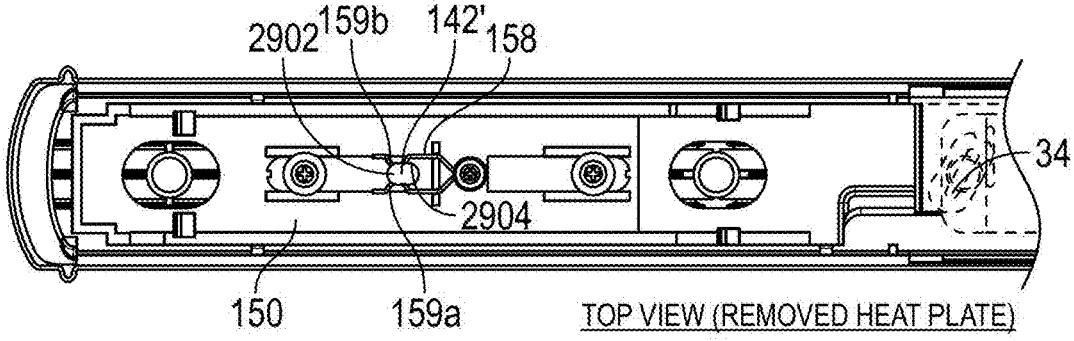
FIG. 44 is a partial, top view of the hair straightening appliance of FIG. 29 with the first heating plate and the second heating plate in the front fixed and rear floating configuration and with the second heating plate removed.
Figure 45:
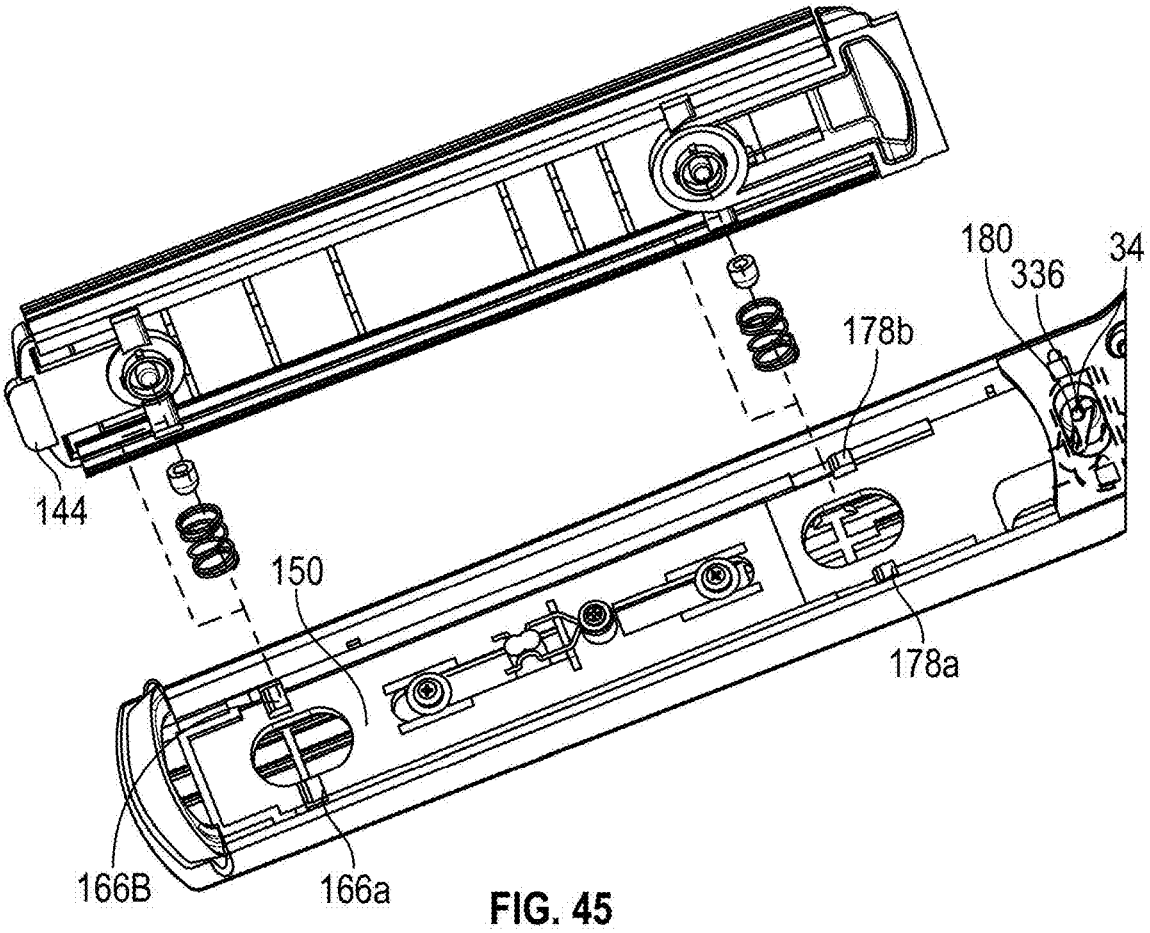
FIG. 45 is a partial exploded, side perspective view of the hair straightening appliance of FIG. 29 with the first heating plate and the second heating plate in the front fixed and rear floating configuration.

Referring to FIG. 39, as the second floating selection switch assembly 34 is moved horizontally to the front fixed and rear floating setting location from the full fixed setting location, as shown in FIGS. 44 and 45, rod 336 moves in cam slot 180 to move or slide sliding block 150 towards rear insulator 160 to the front fixed and rear floating configuration. Alternatively, as the second floating selection switch assembly 34 is moved horizontally to the front fixed and rear floating setting location from the full floating setting location, as shown in FIGS. 44 and 45, rod 336 moves in cam slot 180 to move or slide sliding block 150 towards front insulator 144 to the front fixed and rear floating configuration. When the second floating selection switch assembly 34 is in the front fixed and rear floating location, as shown in FIG. 42, each of front rigid bosses 194, 196 of front insulator 144 are still aligned with front rigid bosses 166*a*, 166*b* of sliding block 150 whereas, as shown in FIG. 43, each of rear rigid bosses 310, 312 of rear insulator 160 are no longer aligned with rear rigid bosses 178*a*, 178*b* of sliding block 150. Instead rear rigid bosses 310, 312 of rear insulator 160 are aligned with a rear portion of sliding block 150 that has a thickness that is less than the portion of sliding block 150 having rear rigid bosses 178*a*, 178*b* so that although movement of front tab 184 of front insulator 144 toward first housing 22 is limited or prevented maintaining a front portion 4100 of first heating plate 12 in the fixed position, rear tab 300 of rear insulator 160 is movable allowing a rear portion 4102 of first heating plate 12 to move or float as shown in FIG. 41. Detent spring 158 is moved with sliding block 150 to be positioned so that protrusions 159*a*, 159*b* of detent spring 158 extend in grooves 2902, 2904 of extension 142' to maintain the second floating selection switch assembly 34 in the front fixed and rear floating location. The front fixed and rear floating setting location could alternatively be the front floating and rear fixed setting location where sliding block 150 is modified so that each of front rigid bosses 194, 196 of front insulator 144 are no longer aligned with front rigid bosses 166*a*, 166*b* of sliding block 150, and, instead front rigid bosses 194, 196 of front insulator 144 are aligned with a front portion of sliding block 150 that has a thickness that is less than the portion of sliding block 150 having front rigid bosses 166*a*, 166*b* whereas each of rear rigid bosses 178*a*, 178*b* of sliding block 150 are still each aligned with one of rear rigid bosses 310, 312 of rear insulator 160 so that front tab 184 of front insulator 144 is movable allowing front portion 4100 of first heating plate 12 to move or float and movement of rear tab 300 of rear insulator 160 toward first housing 22 is limited or prevented maintaining rear portion 4102 of first heating plate 12 in a fixed position.

Figure 46:
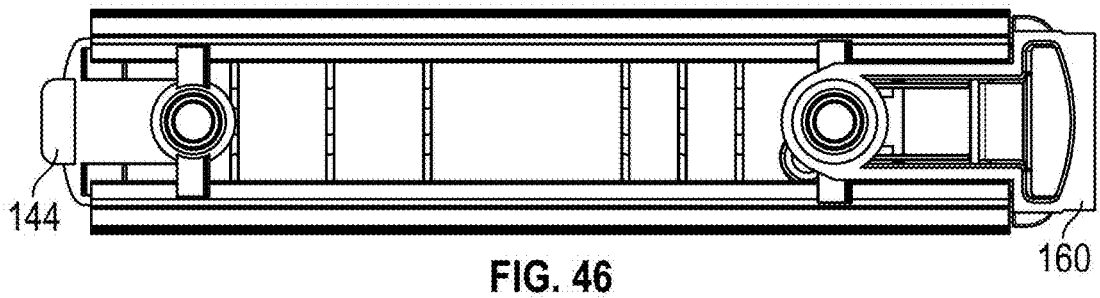
FIG. 46 is a partial bottom view of the hair straightening appliance of FIG. 29 with the first heating plate and the second heating plate in the front fixed and rear floating configuration.
Figure 47:
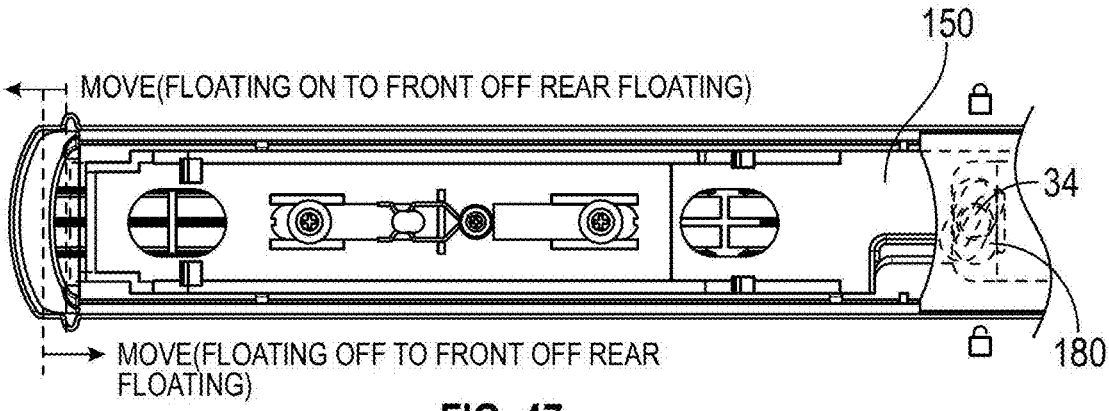
FIG. 47 is a partial, top view of the hair straightening appliance of FIG. 29 with the first heating plate and the second heating plate in the front fixed and rear floating configuration and with the second heating plate removed.

Similarly, as the second floating selection switch assembly 34 is moved horizontally to the front fixed and rear floating setting location from the full fixed setting location, as shown in FIGS. 44 and 45, rod 336 moves in cam slot 180 to move or slide sliding block 150 towards rear insulator 160 to the front fixed and rear floating configuration. Alternatively, as the second floating selection switch assembly 34 is moved horizontally to the front fixed and rear floating setting location from the full floating setting location, as shown in FIGS. 44 and 45, rod 336 moves in cam slot 180 to move or slide sliding block 150 towards front insulator 144 to the front fixed and rear floating configuration. When floating selection switch assembly 34 is in the front fixed and rear floating location, as shown in FIG. 42, each of front rigid bosses 194, 196 of front insulator 144 are still aligned with front rigid bosses 166*a*, 166*b* of sliding block 150 whereas, as shown in FIG. 43, each of rear rigid bosses 310, 312 of rear insulator 160 are no longer aligned with rear rigid bosses 178*a*, 178*b* of sliding block 150. Instead rear rigid bosses 310, 312 of rear insulator 160 are aligned with a rear portion of sliding block 150 that has a thickness that is less than the portion of sliding block 150 having rear rigid bosses 178*a*, 178*b* so that although movement of front tab 184 of front insulator 144 toward second housing 28 is limited or prevented maintaining a first portion 4104 of second heating plate 12 in the fixed position, rear tab 300 of rear insulator 160 is movable allowing a rear portion 4106 of second heating plate 14 to move or float as shown in FIGS. 41 and 46. Detent spring 158 is moved with sliding block 150 to be positioned so that protrusions 159*a*, 159*b* of detent spring 158 extend in grooves 2902, 2904 of extension 142' to maintain floating selection switch assembly 34 in the front fixed and rear floating setting location as shown in FIGS. 44, 45 and 47. The front fixed and rear floating setting location could alternatively be the front floating and rear fixed setting location where sliding block 150 is modified so that each of front rigid bosses 194, 196 of front insulator 144 are no longer aligned with front rigid bosses 166*a*, 166*b* of sliding block 150, and, instead front rigid bosses 194, 196 of front insulator 144 are aligned with a front portion of sliding block 150 that has a thickness that is less than the portion of sliding block 150 having front rigid bosses 166*a*, 166*b* whereas each of rear rigid bosses 178*a*, 178*b* of sliding block 150 are still each aligned with one of rear rigid bosses 310, 312 of rear insulator 160 so that front tab 184 of front insulator 144 is movable allowing front portion 4104 of second heating plate 14 to move or float and movement of rear tab 300 of rear insulator 160 toward second housing 28 is limited or prevented maintaining rear portion 4106 of second heating plate 14 in a fixed position.

Figure 48:
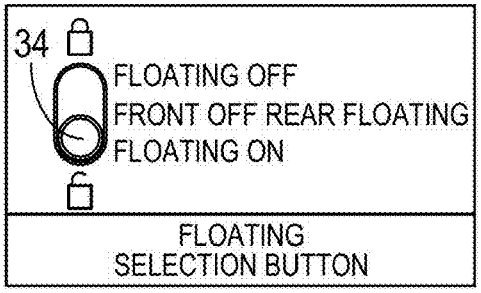
FIG. 48 is an enlarged view of the floating selection switch assembly of the hair straightening appliance of FIG. 29 in a full floating setting location.
Figure 51:
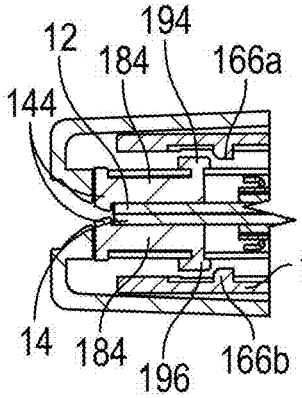
FIG. 51 is a partial, side cross-sectional view taken along line B-B of FIG. 49 of the hair straightening appliance of FIG. 29 with the first heating plate and the second heating plate in the full floating configuration.
Figure 52:
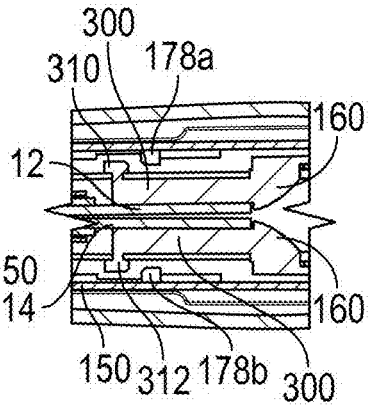
FIG. 52 is a partial, side cross-sectional view taken along line C-C of FIG. 49 of the hair straightening appliance of FIG. 29 with the first heating plate and the second heating plate in the full floating configuration.
Figure 49:
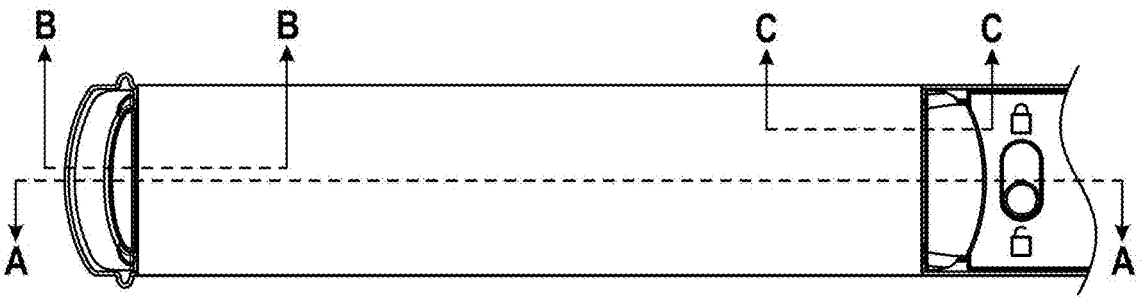
FIG. 49 is a partial, top view of the hair straightening appliance of FIG. 29 with the first heating plate and the second heating plate in a full floating configuration.
Figure 50:
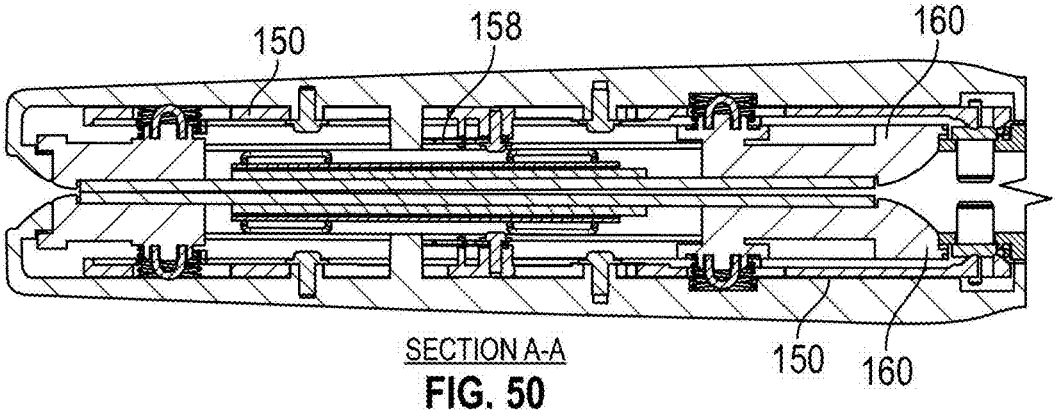
FIG. 50 is a partial, side cross-sectional view taken along line A-A of FIG. 49 of the hair straightening appliance of FIG. 29 with the first heating plate and the second heating plate in the full floating configuration.
Figure 56:
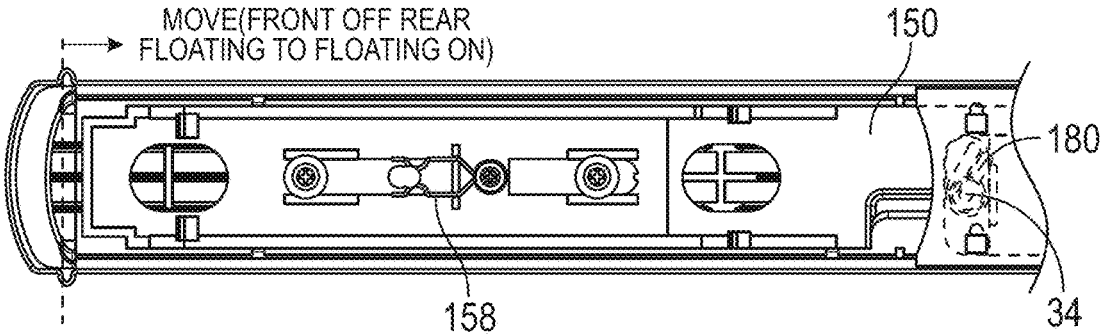
FIG. 56 is a partial, top view of the hair straightening appliance of FIG. 29 with the first heating plate and the second heating plate in the full floating configuration and with the second heating plate removed.

As shown in FIGS. 48 and 56, as the second floating selection switch assembly 34 of first heating plate 12 is moved horizontally to the full floating setting location from the front fixed and rear floating setting location, rod 336 moves in cam slot 180 to move or slide sliding block 150 further towards rear insulator 160 to the full floating configuration. When the second floating selection switch assembly 34 is in the full floating setting location, as shown in FIG. 51, each of front rigid bosses 194, 196 of front insulator 144 are no longer aligned with front rigid bosses 166*a*, 166*b* of sliding block 150, and, instead front rigid bosses 194, 196 of front insulator 144 are aligned with a front portion of sliding block 150. Front portion of sliding block 150 has a thickness that is less than the portion of sliding block 150 having front rigid bosses 166*a*, 166*b* and, as shown in FIG. 52, each of rear rigid bosses 310, 312 of rear insulator 160 are still no longer aligned with rear rigid bosses 178*a*, 178*b* of sliding block 150. Instead rear rigid bosses 310, 312 of rear insulator 160 are aligned with the rear portion of sliding block 150 that has a thickness that is less than the portion of sliding block 150 having rear rigid bosses 178*a*, 178*b* so that both front tab 184 of front insulator 144 and rear tab 300 of rear insulator 160 are movable allowing first heating plate 12 to move or fully float. Detent spring 158 is moved with sliding block 150 to be positioned so that protrusions 159*a*, 159*b* of detent spring 158 extend on a side closest to rear insulator 160 of extension 142' to maintain the second floating selection switch assembly 34 in the floating setting location.

Figure 53:
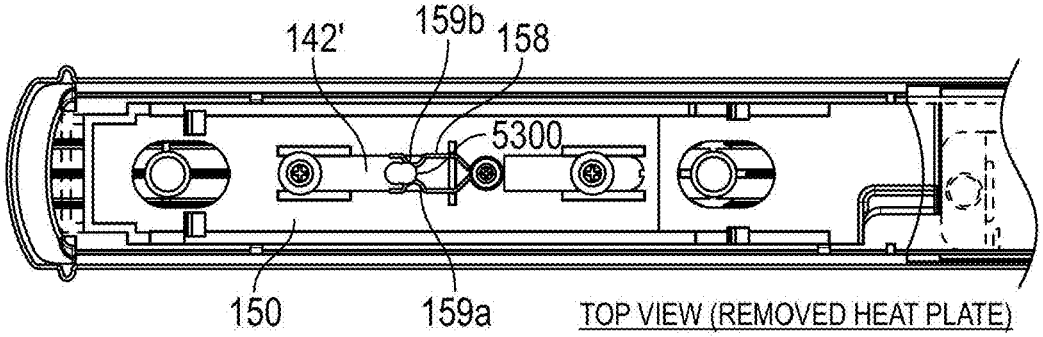
FIG. 53 is a partial, top view of the hair straightening appliance of FIG. 29 with the first heating plate and the second heating plate in the full floating configuration and with the second heating plate removed.
Figure 55:
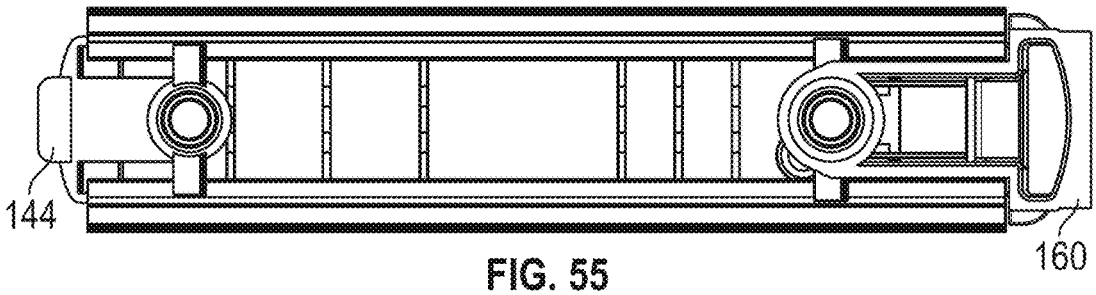
FIG. 55 is a partial bottom view of the hair straightening appliance of FIG. 29 with the first heating plate and the second heating plate in the full floating configuration.
Figure 54:
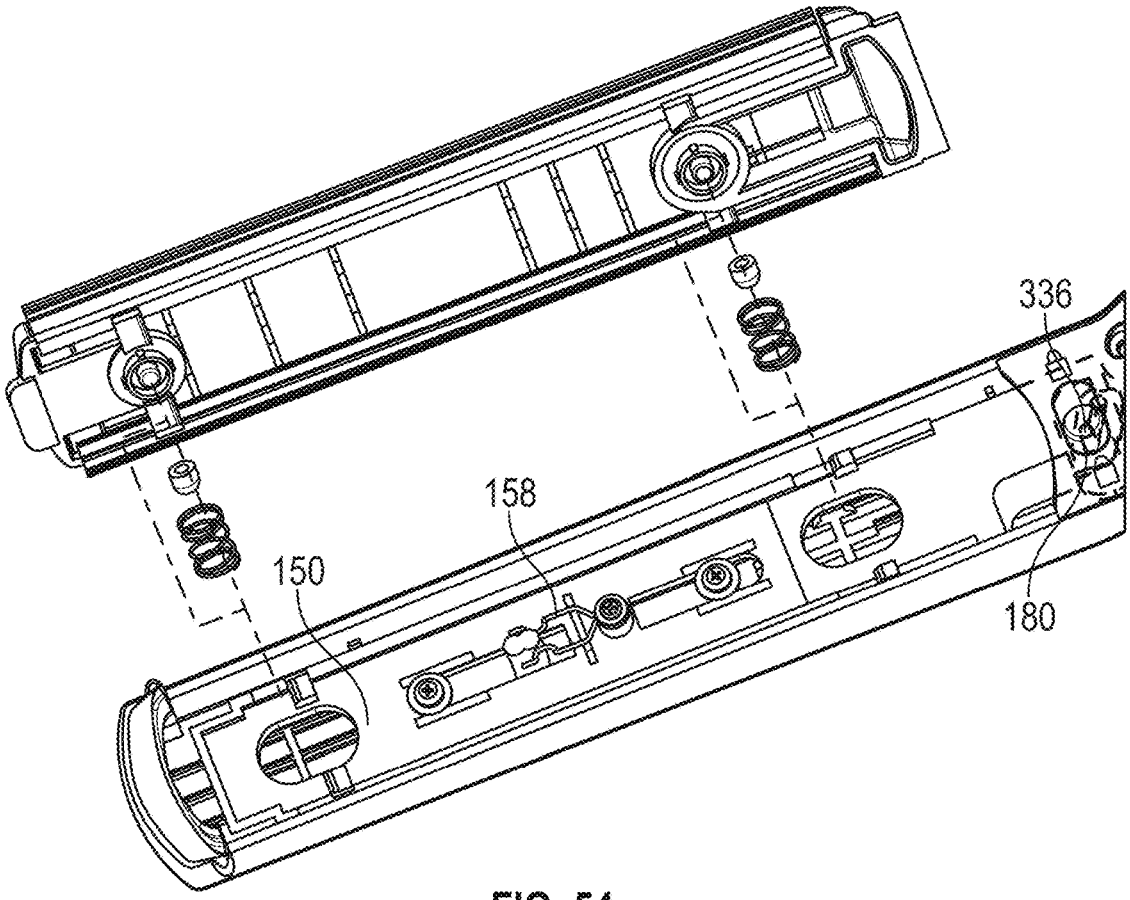
FIG. 54 is a partial exploded, side perspective view of the hair straightening appliance of FIG. 29 with the first heating plate and the second heating plate in the full floating configuration.

Similarly, as floating selection switch assembly 34 of second heating plate 14 is moved horizontally to the full floating setting location from the front fixed and rear floating location, rod 336 moves in cam slot 180 to move or slide sliding block 150 further towards rear insulator 160 to the floating position. When floating selection switch assembly 34 is in the full floating setting location, as shown in FIG. 51, each of front rigid bosses 194, 196 of front insulator 144 are no longer aligned with front rigid bosses 166*a*, 166*b* of sliding block 150, and, instead front rigid bosses 194, 196 of front insulator 144 are aligned with a front portion of sliding block 150. Front portion of sliding block 150 has a thickness that is less than the portion of sliding block 150 having front rigid bosses 166*a*, 166*b* and, as shown in FIG. 52, each of rear rigid bosses 310, 312 of rear insulator 160 are still no longer aligned with rear rigid bosses 178*a*, 178*b* of sliding block 150. Instead rear rigid bosses 310, 312 of rear insulator 160 are aligned with the rear portion of sliding block 150 that has a thickness that is less than the portion of sliding block 150 having rear rigid bosses 178*a*, 178*b* so that both front tab 184 of front insulator 144 and rear tab 300 of rear insulator 160 are movable toward second housing 28 allowing second heating plate 14 to move or fully float. As shown in FIGS. 53, 54 and 56, detent spring 158 is moved with sliding block 150 to be positioned so that protrusions 159*a*, 159*b* of detent spring 158 extend on a side 5300 of extension 142' to maintain floating selection switch assembly 34 in the floating setting location.

In use, first handle 16 and second handle 18 are selectively moved from a closed position where first heating plate 12 and second heating plate 14 are adjacent to each other to an open position where first heating plate 12 and second heating plate 14 are spaced from one another to receive a user's hair. First handle 16 and second handle 18 can be biased toward the open position so that the user can selectively move first handle 16 and second handle 18 from the open position to the closed position during use. One or more buttons 36 can provide inputs to controller 143, for example, to turn appliance 10 on and off, adjust heat, and the like.

During use, the user can selectively move one or both of the second floating selection switch assembly 34 on first handle 16 and/or floating selection switch assembly 34 on second handle 18 between the full fixed setting location as shown in FIGS. 30-38, the front fixed and rear floating setting location as shown in FIGS. 39-47, and the full floating setting location as shown in FIGS. 48-56 as set forth below:

- the second floating selection switch assembly 34 on first handle 16 is in the full fixed setting location with floating selection switch assembly 34 on second handle 18 in the full fixed setting location;
- the second floating selection switch assembly 34 on first handle 16 is in the full fixed setting location with floating selection switch assembly 34 on second handle 18 in the full floating setting location;
- the second floating selection switch assembly 34 on first handle 16 is in the full floating setting location with floating selection switch assembly 34 on second handle 18 in the full fixed setting location;
- the second floating selection switch assembly 34 on first handle 16 is in the front fixed and rear floating setting location with floating selection switch assembly 34 on second handle 18 in the full fixed setting location;
- the second floating selection switch assembly 34 on first handle 16 is in the front fixed and rear floating setting location with floating selection switch assembly 34 on second handle 18 in the full floating setting location;
- the second floating selection switch assembly 34 on first handle 16 is in the full fixed setting location with floating selection switch assembly 34 on second handle 18 in the front fixed and rear floating setting location;
- the second floating selection switch assembly 34 on first handle 16 is in the full floating setting location with floating selection switch assembly 34 on second handle 18 in the front fixed and rear floating setting location;
- the second floating selection switch assembly 34 on first handle 16 is in the front fixed and rear floating setting location with floating selection switch assembly 34 on second handle 18 in the front fixed and rear floating setting location; and
- the second floating selection switch assembly 34 on first handle 16 is in the full floating setting location with floating selection switch assembly 34 on second handle 18 in the full floating setting location.

The ability of the user to selectively move one or both of the second floating selection switch assembly 34 on first handle 16 and/or floating selection switch assembly 34 on second handle 18 between the full fixed setting location as shown in FIGS. 30-38, the front fixed and rear floating setting location as shown in FIGS. 39-47, and the full floating setting location as shown in FIGS. 48-56 can provide the desired attention and control over tension needed for certain hair treatments, for example, a Keratin treatment, for use of appliance 10.

During use, when the second floating selection switch assembly 34 of first heating plate 12 is in the full fixed setting location, the user places a section of the user's hair between first heating plate 12 and second heating plate 14 and moves first handle 16 toward second handle 18 to clamp the user's hair between first heating plate 12 and second heating plate 14. While the user's hair is between first heating plate 12 and second heating plate 14 heat is applied for straightening. Also, while the user's hair between first heating plate 12 and second heating plate 14, a first force is applied to first heating plate 12 in direction opposite direction H shown in FIG. 12 thereby applying a force in the opposite direction to direction H to front insulator 144 so that front rigid bosses 194, 196 each contact one of second front rigid bosses 166*a*, 166*b* of sliding block 150 and applying a force in the opposite direction to direction H to rear insulator 160 so that rear rigid bosses 310, 312 each contact one of rear rigid bosses 178*a*, 178*b* of sliding block 150 that limit or prevent movement of first heating plate 12 toward first housing 22 during use in the full fixed setting location.

Similarly, during use, when floating selection switch assembly 34 of second heating plate 14 is in the full fixed setting location, the user places a section of the user's hair between first heating plate 12 and second heating plate 14 and moves first handle 16 toward second handle 18 to clamp the user's hair between first heating plate 12 and second heating plate 14. While the user's hair is between first heating plate 12 and second heating plate 14 heat is applied for straightening. Also, while the user's hair between first heating plate 12 and second heating plate 14, a first force is applied to first heating plate 12 in direction H shown in FIG. 12 thereby applying a force in the direction H to front insulator 144 so that front rigid bosses 194, 196 each contact one of second front rigid bosses 166*a*, 166*b* of sliding block 150 and applying a force in the opposite direction H to rear insulator 160 so that rear rigid bosses 310, 312 each contact one of rear rigid bosses 178*a*, 178*b* of sliding block 150 that limit or prevent movement of second heating plate 14 toward second housing 28 during use in the fixed setting location.

When the second floating selection switch assembly 34 of first heating plate 12 is in the front fixed and rear floating setting location, the user places a section of the user's hair between first heating plate 12 and second heating plate 14 and moves first handle 16 toward second handle 18 to clamp the user's hair between first heating plate 12 and second heating plate 14. While the user's hair is between first heating plate 12 and second heating plate 14 heat is applied for straightening. Also, while the user's hair between first heating plate 12 and second heating plate 14, a first force is applied to first heating plate 12 in direction opposite direction H shown in FIG. 12 thereby applying a force in the opposite direction to direction H to front insulator 144 so that front rigid bosses 194, 196 each contact one of second front rigid bosses 166*a*, 166*b* of sliding block 150 that limit or prevent movement of front portion 4100 of first heating plate 12 toward first housing 22 during use in the front fixed rear floating setting location. While the first force is applied to first heating plate 12 in direction opposite direction H and the force in the opposite direction to direction H is applied to rear insulator 160, rear rigid bosses 310, 312 are no longer aligned with rear rigid bosses 178*a*, 178*b* of sliding block 150 so rear floating flexible cover 162 and rear floating spring 308 are compressed between rear insulator 160 and first housing 22 allowing movement or floating of rear portion 4102 of first heating plate 12 toward first housing 22. When the forces in the opposite direction to direction H are released when first handle 16 and second handle 18 are moved away from one another, then a bias of rear floating flexible cover 162 and rear floating spring 308 move rear portion 4102 of first heating plate 12 away from first housing 22.

Similarly, when floating selection switch assembly 34 of second heating plate 14 is in the front fixed and rear floating setting location, the user places a section of the user's hair between first heating plate 12 and second heating plate 14 and moves first handle 16 toward second handle 18 to clamp the user's hair between first heating plate 12 and second heating plate 14. While the user's hair is between first heating plate 12 and second heating plate 14 heat is applied for straightening. Also, while the user's hair between first heating plate 12 and second heating plate 14, a first force is applied to second heating plate 14 in direction H shown in FIG. 12 thereby applying a force in the direction H to front insulator 144 so that front rigid bosses 194, 196 each contact one of second front rigid bosses 166*a*, 166*b* of sliding block 150 that limit or prevent movement of front portion 4104 of second heating plate 14 toward second housing 28 during use in the front fixed rear floating setting location. While the first force is applied to second heating plate 14 in direction H and the force in the direction H is applied to rear insulator 160, rear rigid bosses 310, 312 are no longer aligned with rear rigid bosses 178*a*, 178*b* of sliding block 150 so rear floating flexible cover 162 and rear floating spring 308 are compressed between rear insulator 160 and second housing 28 allowing movement or floating of rear portion 4106 of second heating plate 14 toward second housing 28. When the forces in the direction H are released when first handle 16 and second handle 18 are moved away from one another, then a bias of rear floating flexible cover 162 and rear floating spring 308 move rear portion 4106 of second heating plate 14 away from second housing 28.

When the second floating selection switch assembly 34 of first heating plate 12 is in the full floating setting location, the user places a section of the user's hair between first heating plate 12 and second heating plate 14 and moves first handle 16 toward second handle 18 to clamp the user's hair between first heating plate 12 and second heating plate 14. While the user's hair is between first heating plate 12 and second heating plate 14 heat is applied for straightening. Also, while the user's hair is between first heating plate 12 and second heating plate 14, a force is applied in an opposite direction to direction M to first heating plate 12 and front insulator 144. However, front rigid bosses 194, 196 are no longer aligned with front rigid bosses 166*a*, 166*b* of sliding block 150 so front floating flexible cover 146 and front floating spring 148 are compressed between front insulator 144 and first housing 22 allowing movement or floating of first heating plate 12 toward first housing 22 during use in the full floating setting location. When the force is applied in the opposite direction to direction M to first heating plate 12 and rear insulator 160, rear rigid bosses 310, 312 are no longer aligned with rear rigid bosses 178*a*, 178*b* of sliding block 150 so rear floating flexible cover 162 and rear floating spring 308 are compressed between rear insulator 160 and first housing 22 allowing movement or floating of first heating plate 12 toward first housing 22. When the forces in the opposite direction to direction M are released when first handle 16 and second handle 18 are moved away from one another, then a bias of front floating flexible cover 146, front floating spring 148, rear floating flexible cover 162 and rear floating spring 308 move first heating plate 12 away from first housing 22.

Similarly, when floating selection switch assembly 34 of second heating plate 14 is in the full floating setting location, the user places a section of the user's hair between first heating plate 12 and second heating plate 14 and moves first handle 16 toward second handle 18 to clamp the user's hair between first heating plate 12 and second heating plate 14. While the user's hair is between first heating plate 12 and second heating plate 14 heat is applied for straightening. Also, while the user's hair is between first heating plate 12 and second heating plate 14, a force is applied in direction M to second heating plate 14 and front insulator 144. However, front rigid bosses 194, 196 are no longer aligned with front rigid bosses 166*a*, 166*b* of sliding block 150 so front floating flexible cover 146 and front floating spring 148 are compressed between front insulator 144 and second housing 28 allowing movement or floating of second heating plate 14 toward second housing 28 during use in the full floating setting location. When the force is applied in direction M to second heating plate 14 and rear insulator 160, rear rigid bosses 310, 312 are no longer aligned with rear rigid bosses 178*a*, 178*b* of sliding block 150 so rear floating flexible cover 162 and rear floating spring 308 are compressed between rear insulator 160 and second housing 28 allowing movement or floating of second heating plate 14 toward second housing 28. When the forces in direction M are released when first handle 16 and second handle 18 are moved away from one another, then a bias of front floating flexible cover 146, front floating spring 148, rear floating flexible cover 162 and rear floating spring 308 move second heating plate 14 away from second housing 28.

Advantageously, as described herein, appliance 10 is a hair straightening iron that has at least one or both of a first heating plate 12 and a second heating plate 14 that can be selectively adjusted from fixed to floating. In other words, one or both of first heating plate 12 and second heating plate 14 are adjustable to be rigidly fixed in appliance 10, or one or both of first heating plate 12 and second heating plate 14 can be selectively set to "float" in a resilient manner so that when appliance 10 is closed around a user's hair, one or both of first heating plate 12 and second heating plate 14 will give a little bit or retract, under spring bias, so as to not crush the hair and provide the desired attention and control over tension needed for certain hair treatments, for example, a Keratin treatment. Another advantage includes appliance 10 having one or both mechanically activated plates, namely, sliding block 150, that slides so that the adjustable heat plate either sits on rigid bosses, or is suspended on springs (coil or silicone pads). Moreover, appliance 10 advantageously has two positions: the fixed setting location shown in FIGS. 9-17, or the full floating setting location shown in FIGS. 18-26, or the three settings of FIGS. 29-56 that include the full fixed setting location as shown in FIGS. 30-38, the front fixed and rear floating configuration as shown in FIGS. 39-47, and the full floating configuration as shown in FIGS. 48-56.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents can be substituted for elements thereof without departing from the scope of the present disclosure. In addition, many modifications can be made to adapt a particular situation or material to the teachings of the disclosure without departing from the scope thereof. Therefore, it is intended that the present disclosure should not be limited to the particular embodiment(s) disclosed as the best mode contemplated, but that the disclosure will include all embodiments falling within the scope of the appended claims.

What is claimed is:

1. A hair straightening appliance with an adjustable heat plate comprising:

a first handle and a second handle extending along a central longitudinal axis, the first handle and the second handle being configured for relative movement between an open position for receiving hair therebetween and an approximated position for clamping hair, the first handle including a first heating plate and a first housing and the second handle including a second heating plate and a second housing, the first handle and the second handle are each configured to impart a straightening effect on hair when clamped, at least one of the first heating plate and the second heating plate being adjustable, when the first heating plate is adjustable, the first heating plate is selectively mounted rigidly with respect to the first housing or in a partially or fully resiliently mounted manner with respect to the first housing, and, when the second heating plate is adjustable, the second heating plate is selectively mounted rigidly with respect to the second housing or in a partially or fully resiliently mounted manner with respect to the second housing.

2. The hair straightening appliance of claim 1, wherein the second heating plate is a part of a second heating plate assembly that includes a second sliding block that is a mechanically activated plate.

3. The hair straightening appliance of claim 2, wherein the second sliding block slides so that the second heating plate either sits on rigid bosses or is suspended on springs.

4. The hair straightening appliance of claim 2, wherein the second sliding block slides so that the second heating plate either sits on rigid bosses or is suspended on silicone pads.

5. The hair straightening appliance of claim 1, wherein the first heating plate is a part of a first heating plate assembly that includes a first sliding block that is a mechanically activated plate.

6. The hair straightening appliance of claim 5, wherein the first sliding block slides so that the first heating plate either sits on rigid bosses or is suspended on springs.

7. The hair straightening appliance of claim 5, wherein the first sliding block slides so that the first heating plate either sits on rigid bosses or is suspended on silicone pads.

8. The hair straightening appliance of claim 5, wherein the first sliding block is connected to a floating selection switch assembly so that movement of the floating selection switch assembly moves the first sliding block.

9. The hair straightening appliance of claim 2, wherein the second sliding block is connected to a floating selection switch assembly so that movement of the floating selection switch assembly moves the second sliding block.

10. The hair straightening appliance of claim 2, wherein the second sliding block has at least one second front block boss and at least one second rear block boss, and wherein the second heating plate is connected to at least one second front plate boss and at least one second rear plate boss.

11. The hair straightening appliance of claim 10, wherein the second sliding block has the at least one second front block boss aligned with the at least one second front plate boss and the at least one second rear block boss is aligned with the at least second one rear plate boss in a fixed configuration.

12. The hair straightening appliance of claim 10, wherein the second sliding block has the at least one second front block boss that is not aligned with the at least one second front plate boss and the at least one second rear block boss is not aligned with the at least one second rear plate boss in a floating configuration.

13. The hair straightening appliance of claim 5, wherein the first sliding block has at least one first front block boss and at least one first rear block boss, and wherein the first heating plate is connected to at least one first front plate boss and at least one first rear plate boss.

14. The hair straightening appliance of claim 13, wherein the first sliding block has the at least one first front block boss aligned with the at least one first front plate boss and the at least one first rear block boss is aligned with the at least one first rear plate boss in a fixed configuration.

15. The hair straightening appliance of claim 13, wherein the first sliding block has the at least one first front block boss that is not aligned with the at least one first front plate boss and the at least one first rear block boss is not aligned with the at least one first rear plate boss in a floating configuration.

16. The hair straightening appliance of claim 1, wherein the first heating plate is adjustable between three settings that include a fully fixed setting, a front fixed rear floating setting, and a fully floating setting.

17. The hair straightening appliance of claim 1, wherein the second heating plate is adjustable between three settings that include a fully fixed setting, a front fixed rear floating setting, and a fully floating setting.

18. The hair straightening appliance of claim 1, wherein the first heating plate and the second heating plate are each independently adjustable between three settings that include a fully fixed setting, a front fixed rear floating setting, and a fully floating setting.

19. The hair straightening appliance of claim 9, wherein the floating selection switch assembly has a rod that extends through a diagonal shaped opening in the second sliding block.

20. The hair straightening appliance of claim 2, wherein the second housing has a second extension that extends through an opening in the second sliding block, and wherein the second sliding block is connected to a second detent spring that moveably connects with the second extension to maintain the second sliding block in a fixed configuration or a floating configuration.

* * * * *